US012680431B2

(12) United States Patent
Du et al.

(10) Patent No.: US 12,680,431 B2
(45) **Date of Patent: *Jul. 14, 2026**

(54) SAND MONITORING AND CONTROL SYSTEM

(71) Applicants: Schlumberger Technology Corporation, Sugar Land, TX (US); Japan Organization for Metals and Energy Security, Tokyo (JP)

(72) Inventors: Weijia Du, Cambridge (GB); Takayuki Kanno, Kanagawa (JP); Hadrien Dollfus, Kanagawa (JP); Myriam Amour, Paris (FR); Shungo Abe, Tokyo (JP)

(73) Assignees: Schlumberger Technology Corporation, Sugar Land, TX (US); Japan Organization for Metals and Energy Security, Tokyo (JP)

( * ) Notice: Subject to any disclaimer, the term of this patent is extended or adjusted under 35 U.S.C. 154(b) by 402 days.

This patent is subject to a terminal disclaimer.

(21) Appl. No.: 18/361,102

(22) Filed: Jul. 28, 2023

(65) Prior Publication Data

US 2025/0034973 A1 Jan. 30, 2025

(51) Int. Cl.
*E21B 43/12* (2006.01)

(52) U.S. Cl.
CPC ..... *E21B 43/128* (2013.01); *E21B 43/122* (2013.01); *E21B 2200/02* (2020.05); *E21B 2200/20* (2020.05); *E21B 2200/22* (2020.05)

(58) Field of Classification Search
CPC .. E21B 43/128; E21B 43/122; E21B 2200/02; E21B 2200/20; E21B 2200/22; E21B 47/008
See application file for complete search history.

(56) References Cited

U.S. PATENT DOCUMENTS

2008/0262736 A1* 10/2008 Thigpen ..... E21B 43/128 702/9
2020/0072997 A1* 3/2020 Felkl ..... G01V 1/46
2021/0397994 A1 12/2021 Cerrahoglou et al.
2022/0381139 A1* 12/2022 Cerrahoglu ..... E21B 47/07
(Continued)

FOREIGN PATENT DOCUMENTS

KR 20230084833 A * 6/2023 ..... G06N 3/08
WO 2021091562 A1 5/2021
(Continued)

OTHER PUBLICATIONS

Gharagheizi, et al., "Prediction of Sand Production Onset in Petroleum Reservoirs Using a Reliable Classification Approach", Journal Page of Petroleum , vol. 3, Issue 2, Jun. 2017, pp. 280-285.
(Continued)

*Primary Examiner* — Yossef Korang-Beheshti

(57) ABSTRACT

A method can include receiving real-time downhole time series sensor data during production of fluid from a well in fluid communication with a formation reservoir; transforming the real-time downhole time series sensor data to values for a set of predefined model features; detecting a downhole sand event using the values as input to a trained neural network model; and issuing a signal responsive to detection of the downhole sand event.

18 Claims, 13 Drawing Sheets

(56) References Cited

U.S. PATENT DOCUMENTS

| | | | | |
|---|---|---|---|---|
| 2024/0169273 | A1* | 5/2024 | Sridhar, Sr. | G06N 20/00 |
| 2024/0303399 | A1* | 9/2024 | Kara | G06N 3/0442 |

FOREIGN PATENT DOCUMENTS

| | | | |
|---|---|---|---|
| WO | 2021150929 | A1 | 7/2021 |
| WO | 2022174034 | A1 | 8/2022 |
| WO | 2022204723 | A1 | 9/2022 |

OTHER PUBLICATIONS

Search Report and Written Opinion of International Patent Application No. PCT/US2024/039682 dated Nov. 5, 2024, 11 Pages.

Olatunji et al., "Prediction of Sand Production from Oil and Gas Reservoirs in the Niger Delta Using Support Vector Machines SVMs: A Binary Classification Approach", Jul. 2017.

* cited by examiner

SAND MONITORING AND CONTROL SYSTEM

BACKGROUND

A reservoir can be a subsurface formation (e.g., a formation reservoir) that can be characterized at least in part by its porosity and fluid permeability. As an example, a reservoir may be part of a basin such as a sedimentary basin. A basin can be a depression (e.g., caused by plate tectonic activity, subsidence, etc.) in which sediments accumulate. As an example, where hydrocarbon source rocks occur in combination with appropriate depth and duration of burial, a petroleum system may develop within a basin, which may form a reservoir that includes hydrocarbon fluids (e.g., oil, gas, etc.). Various operations may be performed in the field to access such hydrocarbon fluids and/or produce such hydrocarbon fluids. For example, consider equipment operations where equipment may be controlled to perform one or more operations.

In various fields, sand can be entrained in produced hydrocarbon fluid. For example, a formation can include sand and/or sand forming rocks such that sand can be entrained in flowing hydrocarbon fluid. Sand production or sanding often occurs in wells that penetrate soft formations (e.g., compressive strength less than approximately 1,000 psi or 6.9 MPa). Such formations tend to be geologically young (e.g., Tertiary Period) and shallow, with little or no natural cementation.

Sand can cause various types of issues when entrained and produced. For example, sand can plug tubing, casing, flowlines and surface vessels and/or sand can erode equipment, which may lead to loss of well control or unwanted fluid emissions.

In general, produced formation sand is a nuisance, unless recoverable for one or more purposes (e.g., proppant, etc.). Volumes of sand can be a few liters to several hundred cubic meters or more. Various devices are available to help mitigate sand issues. For example, consider devices for downhole sand exclusion, inflow management, production equipment, artificial lift, surface separation, and disposal. Decisions around sand production are not purely economic as regulatory and environmental restrictions have come to play a role in deciding how sand production may be handled.

Various methods, systems, devices, etc., described herein, provide for monitoring sand and may provide for control of sand. For example, consider monitoring sand indirectly through physical property sensor data where one or more models can generate determinations that provide adequate time for decision making for mitigating sand production, handling sand production, etc.

SUMMARY

A method can include receiving real-time downhole time series sensor data during production of fluid from a well in fluid communication with a formation reservoir; transforming the real-time downhole time series sensor data to values for a set of predefined model features; detecting a downhole sand event using the values as input to a trained neural network model; and issuing a signal responsive to detection of the downhole sand event. A system can include a processor; memory accessible to the processor; and processor-executable instructions stored in the memory to instruct the system to: receive real-time downhole time series sensor data during production of fluid from a well in fluid communication with a formation reservoir; transform the real-time downhole time series sensor data to values for a set of predefined model features; detect a downhole sand event using the values as input to a trained neural network model; and issue a signal responsive to detection of the downhole sand event. One or more computer-readable storage media can include processor-executable instructions to instruct a computing system to: receive real-time downhole time series sensor data during production of fluid from a well in fluid communication with a formation reservoir; transform the real-time downhole time series sensor data to values for a set of predefined model features; detect a downhole sand event using the values as input to a trained neural network model; and issue a signal responsive to detection of the downhole sand event. Various other apparatuses, systems, methods, etc., are also disclosed.

This summary is provided to introduce a selection of concepts that are further described below in the detailed description. This summary is not intended to identify key or essential features of the claimed subject matter, nor is it intended to be used as an aid in limiting the scope of the claimed subject matter.

BRIEF DESCRIPTION OF THE DRAWINGS

Features and advantages of the described implementations can be more readily understood by reference to the following description taken in conjunction with the accompanying drawings.

DETAILED DESCRIPTION

This description is not to be taken in a limiting sense, but rather is made merely for the purpose of describing the general principles of the implementations. The scope of the described implementations should be ascertained with reference to the issued claims.

As explained, sand can be a nuisance when producing hydrocarbon fluid from a reservoir. As an example, a computational framework can be implemented in real-time to detect sand behaviors that may result in sand production. In such an example, one or more machine learning (ML) models may be implemented that receive real-time sensor data for physical properties such as, for example, pressure and temperature, and, in response, generate indicators as to one or more types of sand behaviors. For example, consider a ML model that can determine whether sand will be present at a wellhead within a certain time window. As another example, consider a ML model that can determine whether a formation is likely to emit sand responsive to a given flow rate of hydrocarbon fluid.

In various examples, downhole sensors may be deployed to measure physical properties such as, for example, pressure and temperature. As an example, such downhole sensors may be part of a sensor string, a tool string, a casing string, etc. In various examples, downhole sensors may be part of a pump system that includes a downhole pump. For example, consider an electric submersible pump (ESP) that can include a gauge with multiple sensors where the ESP is part of an ESP system that includes a surface control unit and a cable that operatively couples the surface control unit to the ESP. In such an example, a ML model may be deployed as part the gauge, as part of the surface control unit and/or as operatively coupled to the surface control unit. As explained, a ML model can generate determinations as to one or more types of sand behaviors. Where such a ML model is part of or operatively coupled to fluid control equipment (e.g., a pump, a valve, etc.), such determinations may be utilized to instruct the fluid control equipment, for example, to mitigate or otherwise respond to one or more types of sand behaviors.

Below, various environments, systems, types of equipment, frameworks, etc., are described with respect to field operations. As explained, a sand monitoring and control system can improve decision making as to sand, which, in turn, can improve field operations for hydrocarbon fluid production.

Figure 1:
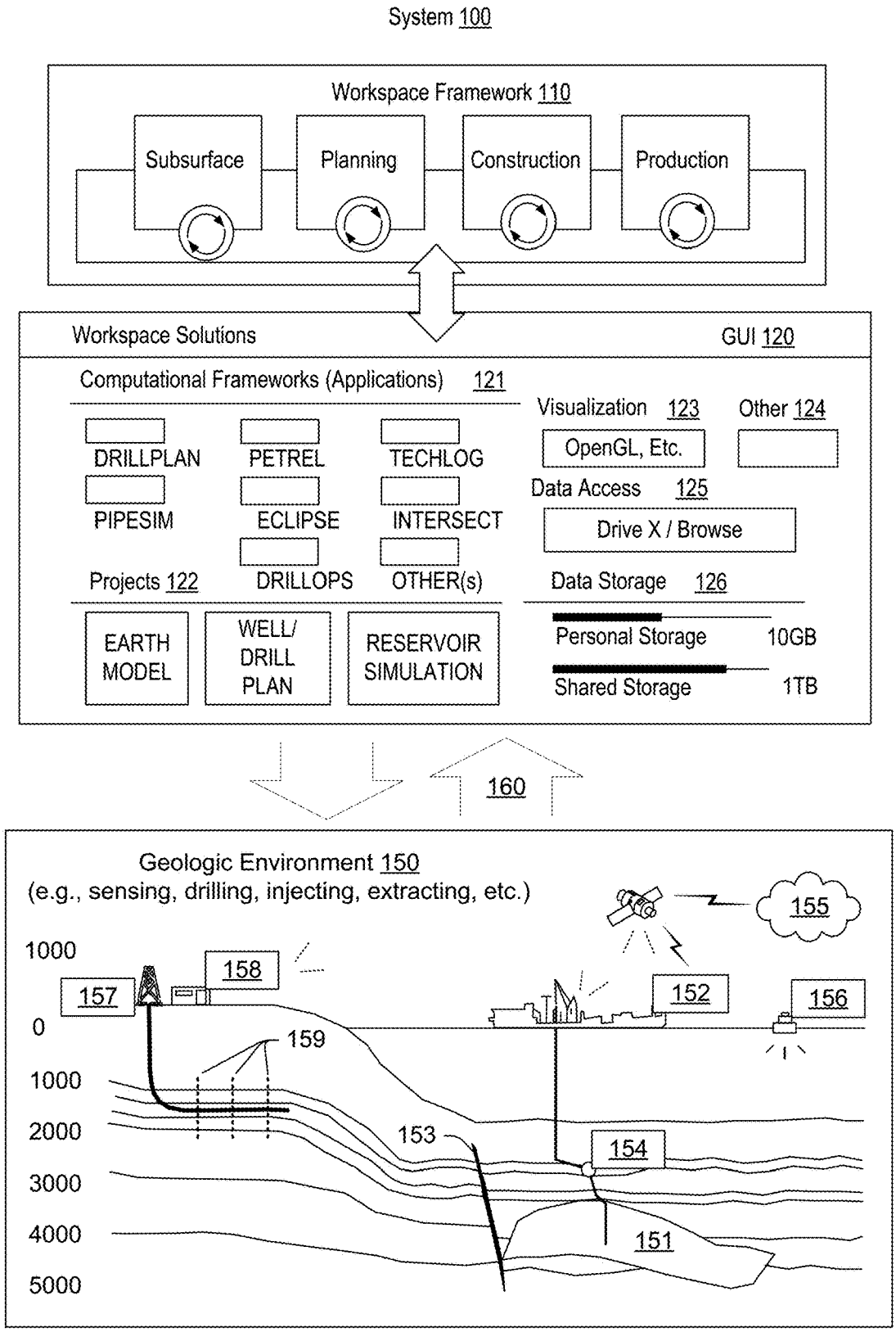
FIG. 1 illustrates an example system that includes various framework components associated with one or more geologic environments.

FIG. 1 shows an example of a system 100 that includes a workspace framework 110 that can provide for instantiation of, rendering of, interactions with, etc., a graphical user interface (GUI) 120. In the example of FIG. 1, the GUI 120 can include graphical controls for computational frameworks (e.g., applications) 121, projects 122, visualization features 123, one or more other features 124, data access 125, and data storage 126.

In the example of FIG. 1, the workspace framework 110 may be tailored to a particular geologic environment such as an example geologic environment 150. For example, the geologic environment 150 may include layers (e.g., stratification) that include a reservoir 151 and that may be intersected by a fault 153. As an example, the geologic environment 150 may be outfitted with a variety of sensors, detectors, predictors, actuators, etc. For example, equipment 152 may include communication circuitry to receive and to transmit information with respect to one or more networks 155. Such information may include information associated with downhole equipment 154, which may be equipment to acquire information, to assist with resource recovery, etc. Other equipment 156 may be located remote from a wellsite and include sensing, detecting, predicting, emitting or other circuitry. Such equipment may include storage and communication circuitry to store and to communicate data, instructions, etc. As an example, one or more satellites may be provided for purposes of communications, data acquisition, etc. For example, FIG. 1 shows a satellite in communication with the network 155 that may be configured for communications, noting that the satellite may additionally or alternatively include circuitry for imagery (e.g., spatial, spectral, temporal, radiometric, etc.).

FIG. 1 also shows the geologic environment 150 as optionally including equipment 157 and 158 associated with a well that includes a substantially horizontal portion that may intersect with one or more fractures 159. For example, consider a well in a shale formation that may include natural fractures, artificial fractures (e.g., hydraulic fractures) or a combination of natural and artificial fractures. As an example, a well may be drilled for a reservoir that is laterally extensive. In such an example, lateral variations in properties, stresses, etc. may exist where an assessment of such variations may assist with planning, operations, etc. to develop a laterally extensive reservoir (e.g., via fracturing, injecting, extracting, etc.). As an example, the equipment 157 and/or 158 may include components, a system, systems, etc. for fracturing, seismic sensing, analysis of seismic data, assessment of one or more fractures, etc.

In the example of FIG. 1, the GUI 120 shows some examples of computational frameworks, including the DRILLPLAN, PETREL, TECHLOG, PETROMOD, ECLIPSE, INTERSECT and DRILLOPS frameworks (SLB, Houston, Texas).

The DRILLPLAN framework provides for digital well construction planning and includes features for automation of repetitive tasks and validation workflows, enabling improved quality drilling programs (e.g., digital drilling plans, etc.) to be produced quickly with assured coherency.

The DRILLOPS framework may execute a digital drilling plan and ensures plan adherence, while delivering goal-based automation. The DRILLOPS framework may generate activity plans automatically individual operations, whether they are monitored and/or controlled on the rig or in town. Automation may utilize data analysis and learning systems to assist and optimize tasks, such as, for example, setting ROP to drilling a stand. A preset menu of automatable drilling tasks may be rendered, and, using data analysis and models, a plan may be executed in a manner to achieve a specified goal, where, for example, measurements may be utilized for calibration. The DRILLOPS framework provides flexibility to modify and replan activities dynamically, for example, based on a live appraisal of various factors (e.g., equipment, personnel, and supplies). Well construction activities (e.g., tripping, drilling, cementing, etc.) may be continually monitored and dynamically updated using feedback from operational activities. The DRILLOPS framework may provide for various levels of automation based on planning and/or re-planning (e.g., via the DRILLPLAN framework), feedback, etc.

The PETREL framework can be part of the DELFI cognitive exploration and production (E&P) environment (SLB, Houston, Texas, referred to as the DELFI environment) for utilization in geosciences and geoengineering, for example, to analyze subsurface data from exploration to production of fluid from a reservoir.

One or more types of frameworks may be implemented within or in a manner operatively coupled to the DELFI environment, which is a secure, cognitive, cloud-based collaborative environment that integrates data and workflows with digital technologies, such as artificial intelligence (AI) and machine learning (ML). As an example, such an environment can provide for operations that involve one or more frameworks. The DELFI environment may be referred to as the DELFI framework, which may be a framework of frameworks. As an example, the DELFI environment can include various other frameworks, which can include, for example, one or more types of models (e.g., simulation models, etc.).

The TECHLOG framework can handle and process field and laboratory data for a variety of geologic environments (e.g., deepwater exploration, shale, etc.). The TECHLOG framework can structure wellbore data for analyses, planning, etc.

The PIPESIM simulator includes solvers that may provide simulation results such as, for example, multiphase flow results (e.g., from a reservoir to a wellhead and beyond, etc.), flowline and surface facility performance, etc. The PIPESIM simulator may be integrated, for example, with the AVOCET production operations framework (SLB, Houston Texas). As an example, a reservoir or reservoirs may be simulated with respect to one or more enhanced recovery techniques (e.g., consider a thermal process such as steam-assisted gravity drainage (SAGD), etc.). As an example, the PIPESIM simulator may be an optimizer that can optimize one or more operational scenarios at least in part via simulation of physical phenomena.

The ECLIPSE framework provides a reservoir simulator (e.g., as a computational framework) with numerical solutions for fast and accurate prediction of dynamic behavior for various types of reservoirs and development schemes.

The INTERSECT framework provides a high-resolution reservoir simulator for simulation of detailed geological features and quantification of uncertainties, for example, by creating accurate production scenarios and, with the integration of precise models of the surface facilities and field operations, the INTERSECT framework can produce reliable results, which may be continuously updated by real-time data exchanges (e.g., from one or more types of data acquisition equipment in the field that can acquire data during one or more types of field operations, etc.). The INTERSECT framework can provide completion configurations for complex wells where such configurations can be built in the field, can provide detailed chemical-enhanced-oil-recovery (EOR) formulations where such formulations can be implemented in the field, can analyze application of steam injection and other thermal EOR techniques for implementation in the field, advanced production controls in terms of reservoir coupling and flexible field management, and flexibility to script customized solutions for improved modeling and field management control. The INTERSECT framework, as with the other example frameworks, may be utilized as part of the DELFI cognitive E&P environment, for example, for rapid simulation of multiple concurrent cases. For example, a workflow may utilize one or more of the DELFI on demand reservoir simulation features.

The aforementioned DELFI environment provides various features for workflows as to subsurface analysis, planning, construction and production, for example, as illustrated in the workspace framework 110. As shown in FIG. 1, outputs from the workspace framework 110 can be utilized for directing, controlling, etc., one or more processes in the geologic environment 150 and, feedback 160, can be received via one or more interfaces in one or more forms (e.g., acquired data as to operational conditions, equipment conditions, environment conditions, etc.).

As an example, a workflow may progress to a geology and geophysics ("G&G") service provider, which may generate a well trajectory, which may involve execution of one or more G&G software packages.

In the example of FIG. 1, the visualization features 123 may be implemented via the workspace framework 110, for example, to perform tasks as associated with one or more of subsurface regions, planning operations, constructing wells and/or surface fluid networks, and producing from a reservoir.

As an example, a visualization process can implement one or more of various features that can be suitable for one or more web applications. For example, a template may involve use of the JAVASCRIPT object notation format (JSON) and/or one or more other languages/formats. As an example, a framework may include one or more converters. For example, consider a JSON to PYTHON converter and/or a PYTHON to JSON converter. In such an approach, one or more features of a framework that may be available in one language may be accessed via a converter. For example, consider the APACHE SPARK framework that can include features available in a particular language where a converter may convert code in another language to that particular language such that one or more of the features can be utilized. As an example, a production field may include various types of equipment, be operable with various frameworks, etc., where one or more languages may be utilized. In such an example, a converter may provide for feature flexibility and/or compatibility.

As an example, visualization features can provide for visualization of various earth models, properties, etc., in one or more dimensions. As an example, visualization features can provide for rendering of information in multiple dimensions, which may optionally include multiple resolution rendering. In such an example, information being rendered may be associated with one or more frameworks and/or one or more data stores. As an example, visualization features may include one or more control features for control of equipment, which can include, for example, field equipment that can perform one or more field operations. As an example, a workflow may utilize one or more frameworks to generate information that can be utilized to control one or more types of field equipment (e.g., drilling equipment, wireline equipment, fracturing equipment, etc.).

As an example, a visualization framework such as the OpenGL framework (Khronos Group, Beaverton, Oregon) may be utilized for visualizations. The OpenGL framework provides a cross-language, cross-platform application programming interface, for example, for rendering 2D and 3D vector graphics where the application programming interface may be used to interact with a graphics processing unit (or units), to achieve hardware-accelerated rendering.

While several simulators are illustrated in the example of FIG. 1, one or more other simulators may be utilized, additionally or alternatively. For example, consider the VISAGE geomechanics simulator (SLB, Houston Texas) or the PETROMOD simulator (SLB, Houston Texas), etc. The VISAGE simulator includes finite element numerical solvers that may provide simulation results such as, for example, results as to compaction and subsidence of a geologic environment, well and completion integrity in a geologic environment, cap-rock and fault-seal integrity in a geologic environment, fracture behavior in a geologic environment, thermal recovery in a geologic environment, $CO_2$ disposal, etc. The PETROMOD framework provides petroleum systems modeling capabilities that can combine one or more of seismic, well, and geological information to model the evolution of a sedimentary basin. The PETROMOD framework can predict if, and how, a reservoir has been charged with hydrocarbons, including the source and timing of hydrocarbon generation, migration routes, quantities, and hydrocarbon type in the subsurface or at surface conditions. The MANGROVE simulator (SLB, Houston, Texas) provides for optimization of stimulation design (e.g., stimulation treatment operations such as hydraulic fracturing) in a reservoir-centric environment. The MANGROVE framework can combine scientific and experimental work to predict geomechanical propagation of hydraulic fractures, reactivation of natural fractures, etc., along with production forecasts within 3D reservoir models (e.g., production from a drainage area of a reservoir where fluid moves via one or more types of fractures to a well and/or from a well). The MANGROVE framework can provide results pertaining to heterogeneous interactions between hydraulic and natural fracture networks, which may assist with optimization of the number and location of fracture treatment stages (e.g., stimulation treatment(s)), for example, to increased perforation efficiency and recovery.

Figure 2:
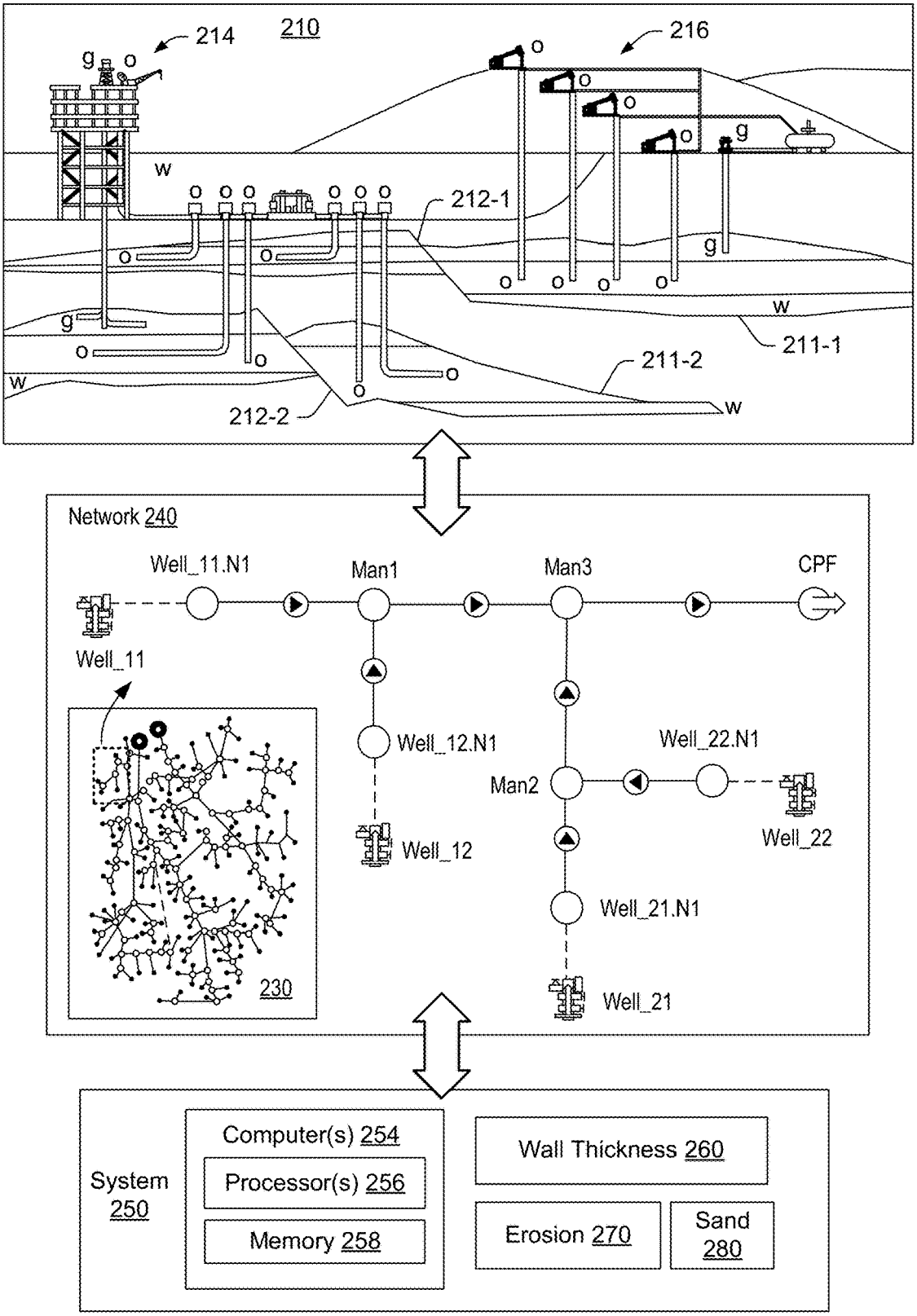
FIG. 2 illustrates examples of equipment, an example of a network and an example of a system.

FIG. 2 shows an example of a geologic environment 210 that includes reservoirs 211-1 and 211-2, which may be faulted by faults 212-1 and 212-2, an example of a network of equipment 230, an enlarged view of a portion of the network of equipment 230, referred to as network 240, and an example of a system 250. FIG. 2 shows some examples of offshore equipment 214 for oil and gas operations related to the reservoir 211-2 and onshore equipment 216 for oil and gas operations related to the reservoir 211-1. In the example of FIG. 2, the geologic environment 210 can include fluids such as oil (o), water (w) and gas (g), which may be stratified in the reservoirs 211-1 and 211-2.

In the example of FIG. 2, the equipment 214 and 216 can include one or more of drilling equipment, wireline equipment, production equipment, etc. For example, consider the equipment 214 as including a drilling rig that can drill into a formation to reach a reservoir target where a well can be completed for production of hydrocarbons. As an example, the equipment 216 can include production equipment such as wellheads, valves, pump equipment, gas handling equipment, etc. As an example, one or more features of the system 100 of FIG. 1 may be utilized for operations in the geologic environment 210. For example, consider utilizing a drilling or well plan framework, a drilling execution framework, a production framework, etc., to plan, execute, etc., one or more drilling operations, production operations, etc.

In FIG. 2, the network 240 can be an example of a relatively small production system network. As shown, the network 240 forms somewhat of a tree like structure where flowlines represent branches (e.g., segments) and junctions represent nodes. As shown in FIG. 2, the network 240 provides for transportation of fluid (e.g., oil, water and/or gas) from well locations (e.g., Well_11, Well_12, Well_21, and Well_22) along flowlines interconnected at junctions with final delivery at a central processing facility (CPF). Where fluid includes solids (e.g., sand, etc.), one or more pieces of equipment may provide for solids removal, collection, etc.

In the example of FIG. 2, various portions of the network 240 may include conduit. For example, consider a perspective view of a geologic environment that includes two conduits which may be a conduit to Man1 and a conduit to Man3 in the network 240, where Man1, Man2 and Man3 are manifolds. In the example of FIG. 2, various portions of the network 230 can include one or more pumps, which can include one or more surface and/or subsurface pumps.

As shown in FIG. 2, the example system 250 includes one or more computers 254 and one or more sets of instructions 260, 270 and 280. As to the one or more computers 254, each computer may include one or more processors (e.g., or processing cores) 256 and memory 258 for storing instructions (e.g., one or more of the sets of instructions 260, 270 and 280), for example, executable by at least one of the one or more processors 256. As an example, a computer may include one or more network interfaces (e.g., wired or wireless), one or more graphics cards, a display interface (e.g., wired or wireless), etc. As an example, imagery such as surface imagery (e.g., satellite, geological, geophysical, etc.) may be stored, processed, communicated, etc. As an example, data may include SAR data, GPS data, etc. and may be stored, for example, in one or more storage devices. As an example, information that may be stored in the one or more storage devices may include information about equipment, location of equipment, orientation of equipment, fluid characteristics, etc.

As an example, the instructions 260 can include instructions (e.g., stored in the memory 258) executable by at least one of the one or more processors 256 to instruct the system 250 to perform various actions related to wall thickness of one or more pieces of equipment (e.g., conduits, etc.), where wall thickness may change as a result of sand being present in hydrocarbon fluid.

As an example, the instructions 270 can include instructions (e.g., stored in the memory 258) executable by at least one of the one or more processors 256 to instruct the system 250 to perform various actions related to erosion of one or more pieces of equipment (e.g., conduits, etc.), where erosion may occur as a result of sand being present in hydrocarbon fluid.

As an example, the instructions 280 can include instructions (e.g., stored in the memory 258) executable by at least one of the one or more processors 256 to instruct the system 250 to perform various actions related to sand, which, as explained, can be liberated by a formation via one or more mechanisms (e.g., entrainment of existing sand, dissolution of formation rock, fracturing of formation rock, etc.).

As an example, the system 250 may be configured to provide for establishing one or more frameworks, for example, consider a framework that can provide for sand monitoring and/or control, a framework that can perform network modeling (see, e.g., the PIPESIM framework of the example of FIG. 1, etc.) and/or other modeling. As an example, one or more methods, techniques, etc. may be performed using one or more sets of instructions.

As an example, various graphics in FIG. 2 may be part of a graphical user interface (GUI) that can be generated using executable instructions that may be executable locally and/or remotely using local and/or remote display devices (e.g., a mobile device, a workstation, etc.).

Figure 3:
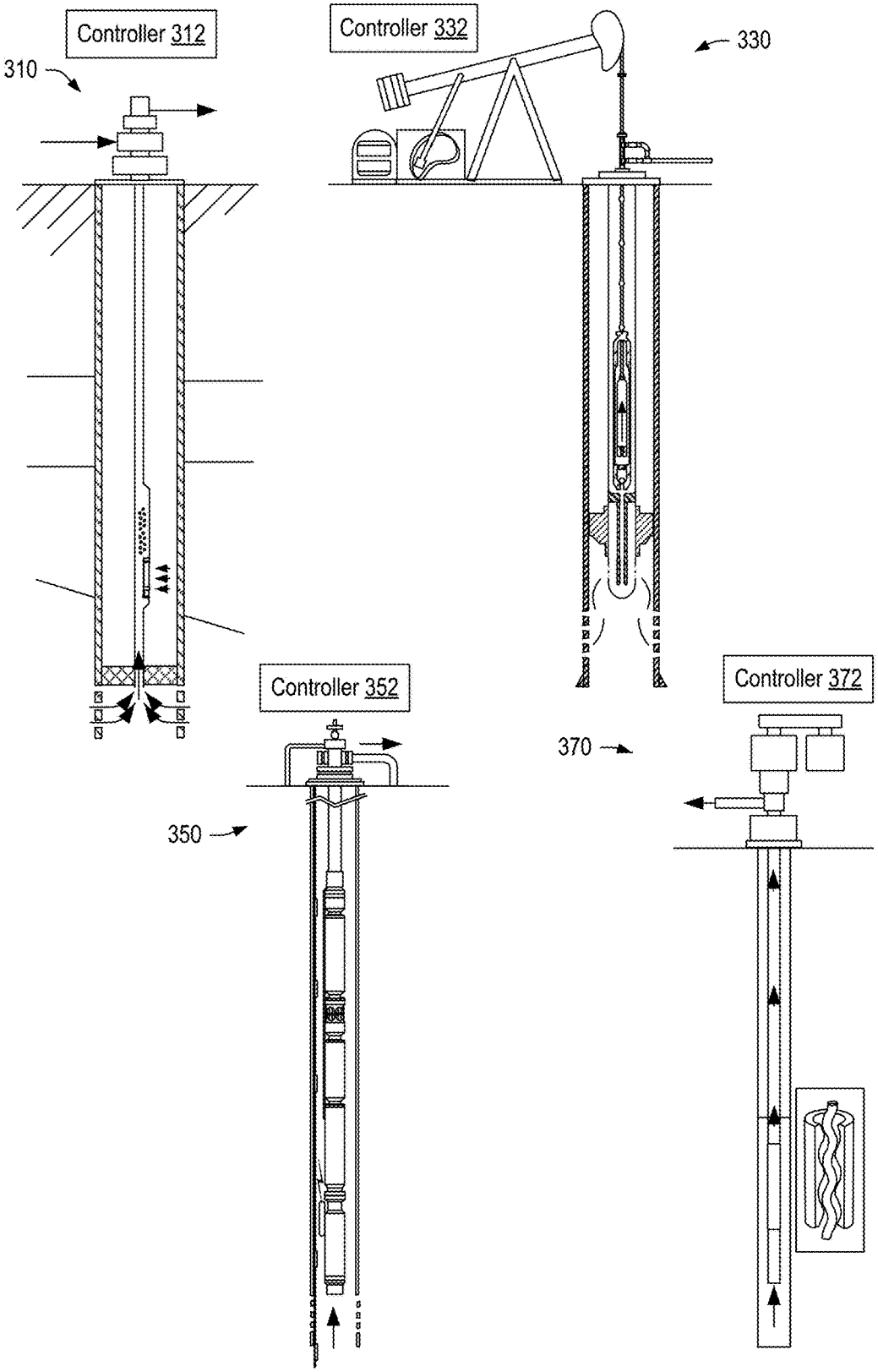
FIG. 3 illustrates examples of equipment.

FIG. 3 shows some examples of equipment 310, 330, 350 and 370 that can be utilized in the field to move fluid. As shown, the equipment 310 can include gas-lift equipment, the equipment 330 can include sucker rod pump equipment, the equipment 350 can include electric submersible pump (ESP) equipment, and the equipment 370 can include progressive cavity pump (PCP) equipment (see, e.g., enlarged inset cutaway view). As an example, a pump may be a compressor (e.g., a centrifugal compressor, a reciprocating compressor, etc.). As an example, a compressor may be a surface and/or a downhole compressor. As mentioned, the network 230 of FIG. 2 can include one or more pumps, which may include one or more of the types of equipment 310, 330, 350 and 370 and/or one or more other types of equipment.

In FIG. 3, the equipment 310, 330, 350 and 370 can be artificial lift equipment, where one or more controllers 312, 332, 352 and 372 can be included with the equipment 310, 330, 350 and 370 and/or operatively coupled to the equipment 310, 330, 350 and 370. In such an example, one or more features of the system 250 may be included in the one or more controllers 312, 332, 352 and 372 and/or operatively coupled to the one or more controllers 312, 332, 352 and 372.

Artificial lift equipment can add energy to a fluid column in a wellbore with the objective of initiating and/or improving production from a well. Artificial lift systems can utilize a range of operating principles (e.g., rod pumping, gas lift, electric submersible pumps, etc.). As such, artificial lift equipment can operate through utilization of one or more resources (e.g., fuel, electricity, gas, etc.).

Gas lift is an artificial lift method in which gas is injected into production tubing to reduce hydrostatic pressure of a fluid column. The resulting reduction in bottomhole pressure allows reservoir liquids to enter a wellbore at a higher flow rate. In gas lift, injection gas can be conveyed down a tubing-casing annulus and enter a production train through a series of gas-lift valves. In such an approach, a gas-lift valve position, operating pressure and gas injection rate may be operational parameters (e.g., determined by specific well conditions, etc.).

A sucker rod pump is an artificial lift pumping system that uses a surface power source to drive a downhole pump assembly. For example, a beam and crank assembly can create reciprocating motion in a sucker rod string that connects to a downhole pump assembly. In such an example, the pump can include a plunger and valve assembly to convert the reciprocating motion to vertical fluid movement. As an example, a sucker rod pump may be driven using electricity and/or fuel. For example, a prime mover of a sucker rod pump can be an electric motor or an internal combustion engine.

An ESP is an artificial lift system that utilizes a downhole pumping system that is electrically driven. In such an example, the pump can include staged centrifugal pump sections that can be specifically configured to suit production and wellbore characteristics of a given application. ESP systems may provide flexibility over a range of sizes and output flow capacities.

A PCP is a type of a sucker rod pumping unit that uses a rotor and a stator. In such an approach, rotation of a rod by means of an electric motor at surface causes fluid contained in a cavity to flow upward. A PCP may be referred to as a rotary positive displacement unit.

A compressor can be a mechanical device that is used to increase pressure of a compressible fluid (e.g., gas, vapor, etc.). A compressor can increase fluid pressure and reduce fluid volume to assist with fluid transport. Compressors find use in the oil and gas industry for applications such as, for example, gas lift, fluid gathering, processing operations of fluid, transmission and distribution systems, reinjection of fluid (e.g., for pressure maintenance, etc.), reduction of fluid volume for storage or shipment by tankers, etc.

In the examples of FIG. 3, one or more sensors may be included. For example, consider a gauge coupled to a downhole end of an ESP where signals from sensors of the gauge can be transmitted to surface equipment using a power cable and/or a dedicated gauge cable. For example, consider the PHOENIX gauge (SLB, Houston, Texas), which include sensors that can measure intake pressure, temperature, motor oil temperature, winding temperature, vibration, current leakage and/or pump discharge pressure. A gauge may be operatively coupled to a controller, which may, for example, provide controls for backspin of an ESP, sanding of an ESP, flux of an ESP and gas related issues of an ESP. For example, during operation where sand is present (e.g., suspended solid matter, etc.), sand may accumulate in one or more stages of an ESP where a control scheme may act to rid the ESP of at least a portion of the sand. As an example, a system that includes one or more pumps may include and/or be operatively coupled to one or more sensors, which may include one or more pressure sensors and one or more temperature sensors. In various instances, presence of sand and/or sanding conditions may be evidenced in pressure data and/or temperature data (e.g., and/or one or more other types of sensor data).

As an example, a PCP may be suitable for use in production for wells characterized by highly viscous fluid and high sand cut where the PCP has some sand-lifting capability. However, sand may accumulate where a control scheme may be utilized to rid the PCP of at least a portion of the sand.

As an example, a sucker rod pump may be operable via as a stroke-through pump to release sand and other material. In such an example, to minimize damage to a plunger and barrel, a grooved-body plunger may be used to catch and carry the sand away from those components.

As an example, gas lift equipment may be utilized in applications where abrasive materials, such as sand, may be present and can be used in low-productivity, high-gas/oil ratio-wells or deviated wellbores. As an example, gas lift equipment such as pocketed mandrels can utilize slickline-retrievable gas lift valves, which may be pulled and replaced without disturbing tubing.

As an example, equipment may include water flooding equipment. For example, consider an enhanced oil recovery (EOR) process in which a small amount of surfactant is added to an aqueous fluid injected to sweep a reservoir. In such an example, presence of surfactant reduces the interfacial tension between oil and water phases and may also alter wettability of reservoir rock (e.g., to improve oil recovery). In such an example, movement of fluid (e.g., oil and/or water) and/or presence of surfactant may carry particles of the reservoir rock to a production well or production wells where such particles (e.g., sand) can result in a sand event, whether one or more of the production well or wells include artificial lift equipment or not. As water flooding becomes more prevalent globally, an increase in sand related issues may be expected (e.g., sand influx into production wells).

As an example, equipment can include a choke or chokes, which can include a surface choke and/or a downhole choke. A choke is a device that includes an orifice that can be used to control flow of fluid through the orifice, for example, to control fluid flow rate, downstream system pressure, etc. Chokes are available in various configurations, which include fixed and adjustable chokes. An adjustable choke enables fluid flow and pressure parameters to be changed as desired (e.g., for process, production, etc.).

An adjustable choke includes a valve that can be adjusted to control well operations, for example, to reduce pressure of a fluid from high pressure in a closed wellbore to atmospheric pressure. An adjustable choke valve may be adjusted (e.g., fully opened, partially opened or closed) to control pressure drop. As an example, an adjustable choke may be manually adjustable or adjustable via a controller that may be integral to or operatively coupled to the adjustable choke. A controller for an adjustable choke may respond to locally generated and/or remotely generated signals.

A downhole choke or bottom hole choke can be a downhole device used to control fluid flow under downhole conditions. As an example, a downhole choke may be removable via slickline intervention where the downhole choke may be located in a landing nipple in a tubing string. In some scenarios, a downhole chock may be used as a flow regulator and to take part of a pressure drop downhole, which may, for example, help to reduce potential of hydrate issues.

Figure 4:
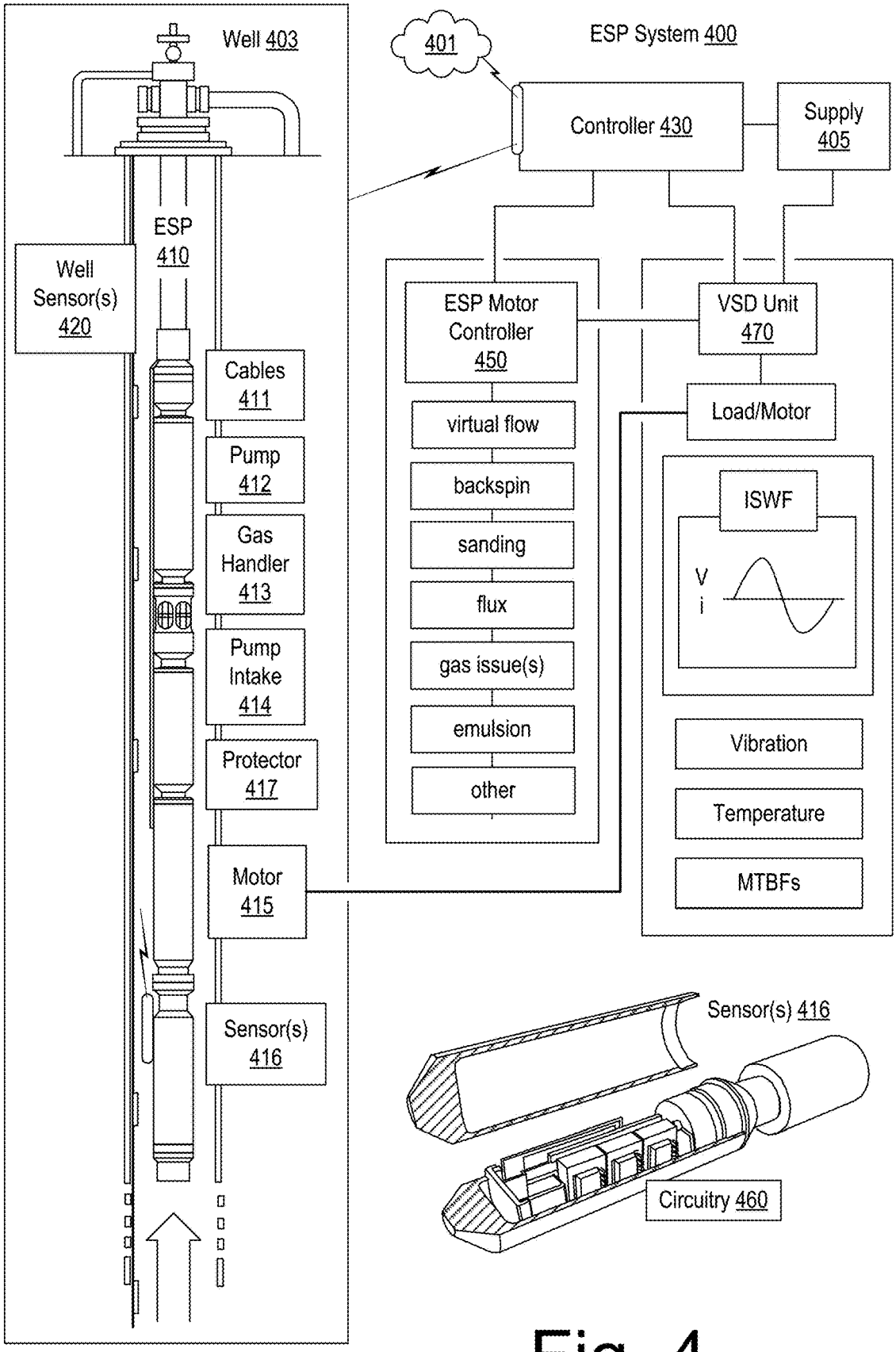
FIG. 4 illustrates an example of a well and an example of an electric submersible pump system.

FIG. 4 shows an example of an ESP system 400 that includes an ESP 410 as an example of equipment that may be placed in a geologic environment. As an example, an ESP may be expected to function in an environment over an extended period of time (e.g., optionally of the order of years).

In the example of FIG. 4, the ESP system 400 includes a network 401, a well 403 disposed in a geologic environment (e.g., with surface equipment, etc.), a power supply 405, the ESP 410, a controller 430, a motor controller 450 and a variable speed drive (VSD) unit 470 (e.g., a surface control unit). The power supply 405 may receive power from a power grid, an onsite generator (e.g., natural gas driven turbine), or other source. The power supply 405 may supply a voltage, for example, of about 4.16 kV.

As shown, the well 403 includes a wellhead that can include a choke (e.g., a choke valve). For example, the well 403 can include a choke valve to control various operations such as to reduce pressure of a fluid from high pressure in a closed wellbore to a lesser pressure (e.g., atmospheric pressure, etc.). A wellhead may include one or more sensors such as a temperature sensor, a pressure sensor, a solids sensor, etc. As an example, a wellhead can include a temperature sensor that acquires temperature data and a pressure sensor that acquires pressure data, noting that a combined temperature and pressure sensor may be included. As an example, a sensor may be crystal based (e.g., quartz crystal based). As an example, a sensor may be a silicon-on-insulator sensor (e.g., consider a METRIS type of sensor, SLB, Houston, Texas).

As to the ESP 410, it is shown as including cables 411 (e.g., or a cable), a pump 412, gas handling features 413, a pump intake 414, a motor 415, one or more sensors 416 (e.g., temperature, pressure, strain, current leakage, vibration, etc.) and a protector 417.

As an example, an ESP may include a REDA HOTLINE high-temperature ESP motor (SLB, Houston, Texas). As an example, an ESP motor can include a three-phase squirrel cage with two-pole induction. As an example, an ESP motor may include steel stator laminations that can help focus magnetic forces on rotors, for example, to help reduce energy loss. As an example, stator windings can include copper and insulation.

As an example, the one or more sensors 416 of the ESP 410 may be part of a digital downhole monitoring system. For example, consider the PHOENIX MULTISENSOR XT150 system (SLB, Houston, Texas). A monitoring system may include a base unit that operatively couples to an ESP motor (see, e.g., the motor 415), for example, directly, via a motor-base crossover, etc. As an example, such a base unit (e.g., base gauge) may measure intake pressure, intake temperature, motor oil temperature, motor winding temperature, vibration, currently leakage, etc. As an example, a base unit may transmit information via a power cable that provides power to an ESP motor and may receive power via such a cable as well.

As shown in the example of FIG. 4, the one or more sensors 416 can include circuitry 460. As an example, such circuitry 460 can include one or more processors and memory that can store processor-executable instructions. As an example, such instructions can include instructions for one or more monitoring and/or control features. As an example, the circuitry 460 may be utilized as an edge device and/or as part of an edge device (see, e.g., FIG. 5).

As an example, a remote unit may be provided that may be located at a pump discharge (e.g., located at an end opposite the pump intake 414). As an example, a base unit and a remote unit may, in combination, measure intake and discharge pressures across a pump (see, e.g., the pump 412), for example, for analysis of a pump curve. As an example, alarms may be set for one or more parameters (e.g., measurements, parameters based on measurements, etc.).

Where a system includes a base unit and a remote unit, such as those of the PHOENIX MULTISENSOR XT150 system, the units may be linked via wires. Such an arrangement provide power from the base unit to the remote unit and allows for communication between the base unit and the remote unit (e.g., at least transmission of information from the remote unit to the base unit). As an example, a remote unit is powered via a wired interface to a base unit such that one or more sensors of the remote unit can sense physical phenomena. In such an example, the remote unit can then transmit sensed information to the base unit, which, in turn, may transmit such information to a surface unit via a power cable configured to provide power to an ESP motor.

In the example of FIG. 4, the well 403 may include one or more well sensors 420, for example, such as the OPTICLINE sensors, WELLWATCHER BRITEBLUE sensors (SLB, Houston, Texas), METRIS sensors (SLB, Houston, Texas), etc. Such sensors are fiber-optic based and can provide for real time sensing of temperature, for example, in SAGD and/or other operations. As shown in the example of FIG. 1, a well can include a relatively horizontal portion. Such a portion may collect heated heavy oil responsive to steam injection. Measurements of temperature along the length of the well can provide for feedback, for example, to understand conditions downhole of an ESP. Well sensors may extend a considerable distance into a well and possibly beyond a position of an ESP.

In the example of FIG. 4, the controller 430 can include one or more interfaces, for example, for receipt, transmission or receipt and transmission of information with the motor controller 450, a VSD unit 470, the power supply 405 (e.g., a gas fueled turbine generator, a power company, etc.), the network 401, equipment in the well 403, equipment in another well, etc.

As an example, the controller 430 may include features of an ESP motor controller and optionally supplant the ESP motor controller 450. For example, the controller 430 may include features of the INSTRUCT motor controller (SLB, Houston, Texas) and/or features of the UNICONN motor controller (SLB, Houston, Texas), which may connect to a SCADA system, the ESPWATCHER surveillance system (SLB, Houston, Texas), the LIFTWATCHER system (SLB, Houston, Texas), LIFTIQ system (SLB, Houston, Texas), etc. The UNICONN motor controller and/or the INSTRUCT motor controller can perform some control and data acquisition tasks for ESPs, surface pumps or other monitored wells. As an example, a motor controller can interface with the aforementioned PHOENIX monitoring system, for example, to access pressure, temperature and vibration data and various protection parameters as well as to provide direct current power to downhole sensors. As an example, a motor controller can interface with fixed speed drive (FSD) controllers or a VSD unit, for example, such as the VSD unit 470.

For FSD controllers, a motor controller can monitor ESP system three-phase currents, three-phase surface voltage, supply voltage and frequency, ESP spinning frequency and leg ground, power factor and motor load. For VSD units, a motor controller can monitor VSD output current, ESP running current, VSD output voltage, supply voltage, VSD input and VSD output power, VSD output frequency, drive loading, motor load, three-phase ESP running current, three-phase VSD input or output voltage, ESP spinning frequency, and leg-ground.

In the example of FIG. 4, the ESP motor controller 450 includes various modules to handle, for example, virtual flow estimations, backspin of an ESP, sanding of an ESP, flux of an ESP, gas issues of an ESP, emulsion presence, emulsion formation, etc. The motor controller 450 may include any of a variety of features, additionally, alternatively, etc.

In the example of FIG. 4, the VSD unit 470 may be a low voltage drive (LVD) unit, a medium voltage drive (MVD) unit or other type of unit (e.g., a high voltage drive, which may provide a voltage in excess of about 4.16 kV). As an example, the VSD unit 470 may receive power with a voltage of about 4.16 kV and control a motor as a load with a voltage from about 0 V to about 4.16 kV. The VSD unit 470 may include control circuitry such as the SPEEDSTAR MVD control circuitry (SLB, Houston, Texas).

Figure 5:
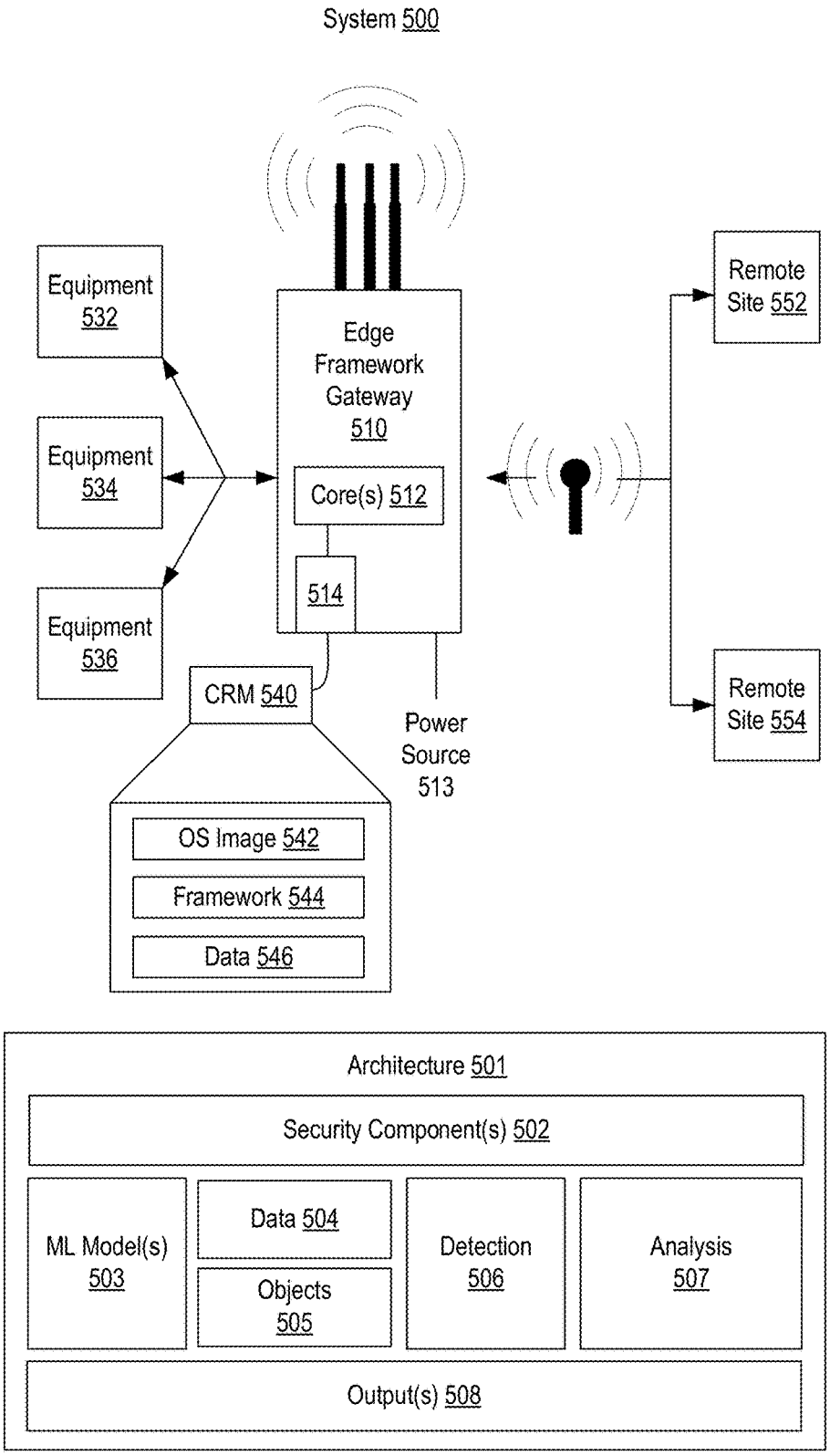
FIG. 5 illustrates an example of a system.

FIG. 5 shows an example of a system 500 and an example of an architecture 501 where the system 500 can include various local components that can be in communication with one or more remote components. As shown in the example of FIG. 5, the architecture 501 can provide for one or more security components 502, one or more machine learning models 503, data 504, objects 505, detection techniques 506 (e.g., recognition, detection, prediction, etc.), analysis techniques 507 and output(s) 508. As an example, the system 500 may be operatively coupled to one or more pieces of equipment. As an example, the system 500 may operate as a controller, a motor controller, a valve controller, a pump controller, etc., and/or provide information to a controller, etc.

As shown, the system 500 can include a power source 513 (e.g., solar, generator, batter, grid, etc.) that can provide power to an edge framework gateway 510 that can include one or more computing cores 512 and one or more media interfaces 514 that can, for example, receive a computer-readable medium 540 that may include one or more data structures such as an operating system (OS) image 542, a framework 544 and data 546. In such an example, the OS image 542 may cause one or more of the one or more cores 512 to establish an operating system environment that is suitable for execution of one or more applications. For example, the framework 544 may be an application suitable for execution in an established operating system in the edge framework gateway 510.

In the example of FIG. 5, the edge framework gateway 510 ("EF") can include one or more types of interfaces suitable for receipt and/or transmission of information. For example, consider one or more wireless interfaces that may provide for local communications at a site such as to one or more pieces of local equipment, which can include equipment 532, equipment 534 and equipment 536 and/or remote communications to one or more remote sites 552 and 554. In such an example, lesser or more equipment may be included.

As mentioned, the circuitry 460 of the one or more sensors 416 of the example of FIG. 4 can be utilized as an edge device and/or as part of an edge device. As an example, the circuitry 460 can include and/or host a framework such as the framework 544. As an example, the circuitry 460 can include and/or host containerized instructions. As an example, the circuitry 460 may be operatively coupled to one or more pieces of surface equipment such as, for example, the edge framework gateway 510 of FIG. 5. As an example, an ESP may be equipped with its own edge computing resources that can, at least in part, operate downhole for monitoring and/or control of the ESP. In various examples, one or more downhole sensors may acquire one or more pressures, one or more temperatures, a drive frequency, etc., which may be inputs to one or more models, monitoring and/or control components, etc.

As an example, the equipment 532, 534 and 536 may include one or more types of equipment such as the equipment 310, the equipment 330, the equipment 350 and the equipment 370 of FIG. 3. As an example, equipment may include non-artificial lift equipment and/or artificial lift equipment.

As an example, the EF 510 may be installed at a site where the site is some distance from a city, a town, etc. In such an example, the EF 510 may be accessible via a satellite communication network and/or one or more other networks where data, control instructions, etc., may be transmitted, received, etc.

As an example, one or more pieces of equipment at a site may be controllable locally and/or remotely. For example, a local controller may be an edge framework-based controller that can issue control instructions to local equipment via a local network and a remote controller may be a cloud-based controller or other type of remote controller that can issue control instructions to local equipment via one or more networks that reach beyond the site. As an example, a site may include features for implementation of local and/or remote control. As an example, a controller may include an architecture such as a supervisory control and data acquisition (SCADA) architecture.

As an example, data from one or more field sensors may be acquired in real-time where such data may be processed locally and/or remotely. For example, consider processing locally using an EF gateway such as, for example, the EF gateway 510 of FIG. 5. In such an example, local processing may provide for expedited output, which may be utilized for control and/or one or more other purposes. As to remote processing, consider transmission via one or more networks of data and/or processed data to one or more remote locations where output may be generated remotely. In comparison to local processing, remote processing may introduce some amount of delay (e.g., latency) such that output may be considered near real-time output. In various examples, output can be generated based at least in part on real-time data where such output may have some amount of delay due to one or more of transmission, processing, etc. Such output may be detection output, which may be in real-time or near real-time depending on various transmission and/or processing techniques, technologies, etc., that may be implemented. In various examples, output is generated with a sufficient amount of time to take one or more actions, for example, to account for detection of an event (e.g., a sanding event).

As an example, output from a local device (e.g., an edge device) may be more rapid than output generated by uploading data and/or partially processed data to equipment of a remote cloud platform, which may cause some time delay (e.g., due to data transmission, queuing, etc.). In various examples, output may be near real-time as to detection, which may account for transmission, queuing, etc., noting that on-site detection by an edge device may operate with lesser delay (e.g., minimal latency or low latency).

As to types of transmission technologies, satellite communication tends to be slower and more costly than other types of electronic communication due to factors such as distance, equipment, deployment and maintenance. For wellsites that do not have other forms of communication, satellite communication may be somewhat limiting in one or more aspects. For example, where a controller is to operate in real-time or near real-time, a cloud-based approach to control may introduce some amount of latency.

As shown in the example of FIG. 5, the EF 510 may be deployed where it can operate locally with the one or more pieces of equipment 532, 534 and 536, etc. As an example, the EF 510 may include switching and/or communication capabilities, for example, for information transmission between equipment, etc.

As desired, from time to time, communication may occur between the EF 510 and one or more remote sites 552, 554, etc., which may be via satellite communication where latency and costs are tolerable. As an example, the CRM 540 may be a removable drive that can be brought to a site via one or more modes of transport. For example, consider an air drop via a drone, a human via helicopter, plane, boat, etc.

As explained with respect to FIG. 5, an EF may execute within a gateway such as, for example, an AGORA gateway (e.g., consider one or more processors, memory, etc., which may be deployed as a "box" that can be locally powered and that can communicate locally with other equipment via one or more interfaces). As an example, one or more pieces of equipment may include computational resources that can be akin to those of an AGORA gateway or more or less than those of an AGORA gateway. As an example, an AGORA gateway may be a network device with various networking capabilities.

As an example, a gateway can include one or more features of an AGORA gateway (e.g., v.202, v.402, etc.) and/or another gateway. For example, consider features such as an INTEL ATOM E3930 or E3950 dual core with DRAM and an eMMC and/or SSD. Such a gateway may include a trusted platform module (TPM), which can provide for secure and measured boot support (e.g., via hashes, etc.). A gateway may include one or more interfaces (e.g., Ethernet, RS485/422, RS232, etc.). As to power, a gateway may consume less than about 100 W (e.g., consider less than 10 W or less than 20 W). As an example, a gateway may include an operating system (e.g., consider LINUX DEBIAN LTS or another operating system). As an example, a gateway may include a cellular interface (e.g., 4G LTE with global modem/GPS, 5G, etc.). As an example, a gateway may include a WIFI interface (e.g., 802.11 a/b/g/n). As an example, a gateway may be operable using AC 100-240 V, 50/60 Hz or 24 VDC. As to dimensions, consider a gateway that has a protective box with dimensions of approximately 10 in×8 in×4 in (e.g., 25 cm×20.3 cm×10.1 cm).

As explained, a gateway can include features that enhance its operation at a remote site that may be distant from a city, a town, etc., such that travel to the site and/or communication with equipment at the site is problematic and/or costly. As explained, a gateway can include an operating system and memory that can store one or more types of applications that may be executable in an operating system environment. Such applications can include one or more security applications, one or more control applications, one or more simulation applications, etc.

As an example, various types of data may be available, for example, consider real-time data from equipment and ad hoc data. In various examples, data from sources connected to a gateway may be real-time, ad hoc data, sporadic data, etc. As an example, lab test data may be available that can be used to fine tune one or more models (e.g., locally, etc.). As an example, data from a framework such as the AVOCET framework may be utilized where results and/or data thereof can be sent to the edge. As an example, one or more types of ad hoc data may be stored in a database and sent to the edge.

As to real-time data, it can include data that are acquired via one or more sensors at a site and then transmitted after acquisition, for example, to a framework, which may be local, remote or part local and part remote. Such transmissions may be as streams (e.g., streaming data) and/or as batches. As to batches, a buffer may be utilized where an amount of data may be stored and then transmitted as a batch. In various instances, real-time data may be characterized using a sampling rate or sampling frequency. For example, consider 1 Hz as a sampling frequency that is adequate to track various types of physical phenomena that can occur during well operations. As an example, a sensor and/or a framework may provide for adjustment of sampling (e.g., at the sensor and/or at the framework). In various instances, data from multiple sensors may be at the same sampling rate or at one or more sampling rates.

As explained, various systems may operate in a local manner, optionally without access to a network such as the Internet. For example, a site may be relatively remote where satellite communication exists as a main mode of communication, which may be costly and/or low bandwidth. In such scenarios, security may resort to local features rather than a remote feature such as a remote authentication server.

In the example of FIG. 5, the edge framework 544 can be an edge-enabled data processing framework. As an example, such a framework can include features to perform one or more of the followings tasks: real-time data cleansing, synchronizing information from existing well metrology (e.g., wellhead, tubing, flow, ESP, etc.); executing one or more machine learning (e.g., supervised learning, unsupervised learning, etc.) models in real-time (e.g., one or more ML models that can identify one or more issues, etc.); and conveying a control set point to a controller (e.g., an actuatable valve, etc.) and/or one or more other pieces of equipment. As mentioned, an edge framework may be deployable using downhole circuitry (see, e.g., the circuitry 460 of FIG. 4), which may be downhole circuitry operatively coupled to surface circuitry, etc.

The system 500 can be part of an infrastructure that serves as a secure gateway to transmit surveillance into an operator's surveillance station or its own surveillance platform. The presence of such a gateway can also support an operator for introduction of one or more additional IIOT (industrial internet of things) implementations.

As an example, one or more of the controllers of FIG. 3 and FIG. 4 may include or provide access to one or more frameworks, applications, etc. As an example, one or more of the controllers of FIG. 3 and FIG. 4 can include one or more features of the system 500 of FIG. 5.

As explained, an ESP can be implemented at a site for pumping fluid, whether for injection or production. For example, an ESP may be utilized in a stimulation treatment to inject fluid that includes various chemicals and an ESP may be utilized as an artificial lift technology to assist production of fluid from a reservoir.

As ESPs find various uses in various environments, knowledge as to operation, performance, etc., can be spread amongst various domains where each domain may have its own experts.

As an example, a system can provide for failure prediction and/or run-life estimation for one or more pumps for one or more purposes, which can include control and/or prognostic health monitoring (PHM). In various instances, sand may impact operation of a pump and/or other equipment.

Pump systems are prone to failures due to various reasons that may lead to substantial downtime and affect production. As an example, a method can include detecting, in advance, potential failures by using a sequence of complex ML models. In such an example, models can learn pump behavior during uptimes and provide a probability curve that can be used to for issuance of one or more types of signals (e.g., alarms, control, etc.). For example, a signal can alert a controller and/or one or more operators when a precursor to a failure may be detected.

As to ESPs, failures can be caused due to multiple reasons including operating conditions like pump wear, no flow, tubing leak, gas interference that may or may not exhibit predefined signal signatures. ESP failures may also be caused by abrupt and unexpected conditions such as startup and shutdown cycles that induce a lot of stress, and electrical failures which do not exhibit signatures. In various instances, sand can be a source of wear, damage, failure, etc., of an ESP.

An ESP can be coupled to a cable, which can be of a substantial length (e.g., hundreds of meters, thousands of meters). A cable can include various conductors, insulation and strength members and may include armor or another material for protection. In various instances, a cable may support an ESP while in other instances an ESP may be supported in another manner. As explained, a cable can provide multiphase power for operation of an electric motor and, where fit with a gauge of one or more sensors, a cable can provide electrical power for operation of the gauge and for transmission of acquired sensor data. Various types of failures can be cable-related (e.g., ground faults, etc.). In various instances, a type of failure or types of failures may be related to the presence of sand in fluid from a reservoir.

Figure 6:
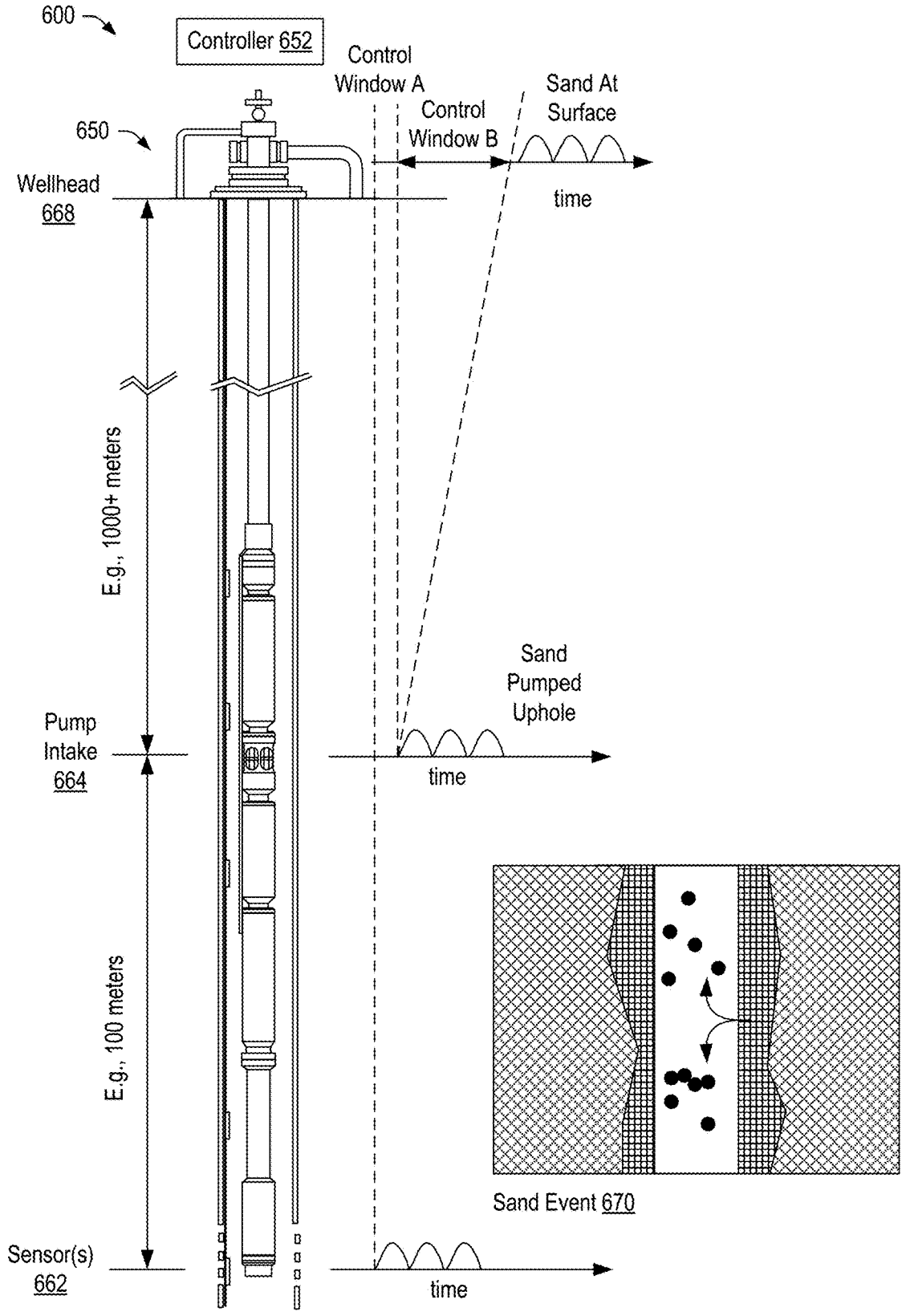
FIG. 6 illustrates an example of a system.

FIG. 6 shows an example of a system 600 that includes a pump system disposed in a wellbore of a well with a wellhead 650 along with a controller 652. In the example of FIG. 6, the pump system may be an ESP system that includes one or more of the features of the ESP system 400 of FIG. 4, noting that the system 600 may include one or more well sensors such as, for example, the one or more well sensors 420 of FIG. 4. As an example, the controller 652 can include one or more of the features of the system 500 of FIG. 5. For example, the controller 652 can be or include an edge framework gateway. As explained, an ESP system can include downhole circuitry such as, for example, the circuitry 460 as shown in FIG. 4. As an example, one or more components of the system 600 of FIG. 6 may provide for oil and/or gas field sand monitoring and/or control.

In the example of FIG. 6, one or more sensors 662 can be at a measured depth below a pump intake 664, which can be at a measured depth below a wellhead 668, which may be a land or sea wellhead. As shown, the distance between the pump intake 664 and the one or more sensors 662 may be approximately 100 meters while the distance between the pump intake 664 and the wellhead 668 may be approximately 1,000 meters or more. As explained, sand may be liberated from a formation such that data from the one or more sensors 662 can be utilized to detect a sand event 670, which is shown graphically as sand particles emerging from a formation into a borehole along with amplitudes of sensor data with respect to time. As shown, the sand event 670 can be a physical presence of sand that reaches the pump intake 664 at a later time, which can depend on various factors such as pump flow rate, amount of sand, type of sand, etc. In such an example, a control window, labeled control window A, can exist for taking action prior to sand of the sand event 670 reaching the pump intake 664. Further, as shown, another control window, labeled control window B, can exist for taking action prior to the sand of the sand event 670 reaching the wellhead 668, where control window B is longer than control window A. As to timing of control action, it can depend, for example, on where sensor data are received for processing. For example, if downhole components can receive and process the sensor data, it may be possible to take action during control window A (e.g., to adjust operation of the pump before the sand reaches the pump intake 664). As an example, an oil and/or gas field sand monitoring and control system may be capable of taking action in one or more time windows, which may depend on choice, available equipment, etc.

In the example of FIG. 6, the one or more sensors 662 can include one or more pressure sensors and one or more temperature sensors such that pressure and temperature data can be utilized to detect the sand event 670. As explained, a ML model may be utilized to predict sand behavior. As an example, data from one or more downhole sensors and one or more surface sensors may be utilized as training data to train a ML model. For example, consider downhole pressure and temperature data and associated surface sand detection data, which may be considered labeled data. Such data may be input to a ML model framework to train a ML model to predict presence of surface sand based on downhole pressure and temperature data.

As explained, during hydrocarbon fluid production, production equipment can face a sanding issue where there is production of downhole sand that confounds fluid production. Sand can be a nuisance that can cause damage, clogging, introduction of non-productive time (NPT), etc. As explained, downhole sensors can be deployed in a production well and at surface to monitor proper fluid extraction. As an example, a system can utilize sensor data from such sensors to detect in real-time risk of sanding occurrence before sand actually flows to the surface. Such a system may be utilized for purposes of planning, drilling, completions, pumping, production, etc. As to planning, a system may be utilized as part of a simulation workflow where simulated physical phenomena can provide for data equivalent to sensor data such that risks of sand flowing to surface may be assessed and adjustments made to a plan. As an example, one or more simulators may be utilized in a control scenario, for example, to determine an appropriate control response for a field operation at one or more field sites. As an example, a system for prediction of sand behavior may be utilized with one or more types of downhole equipment. For example, consider pumps, wireline tools, gas lift tools, etc. As explained, one or more sensors may be provided as part of equipment such as a pump, a tool string, etc., or may be provided as part of dedicated sensing equipment (e.g., a fiber cable, a sensor string, etc.). Various sensors may be temporary or fixed in a well.

Figure 7:
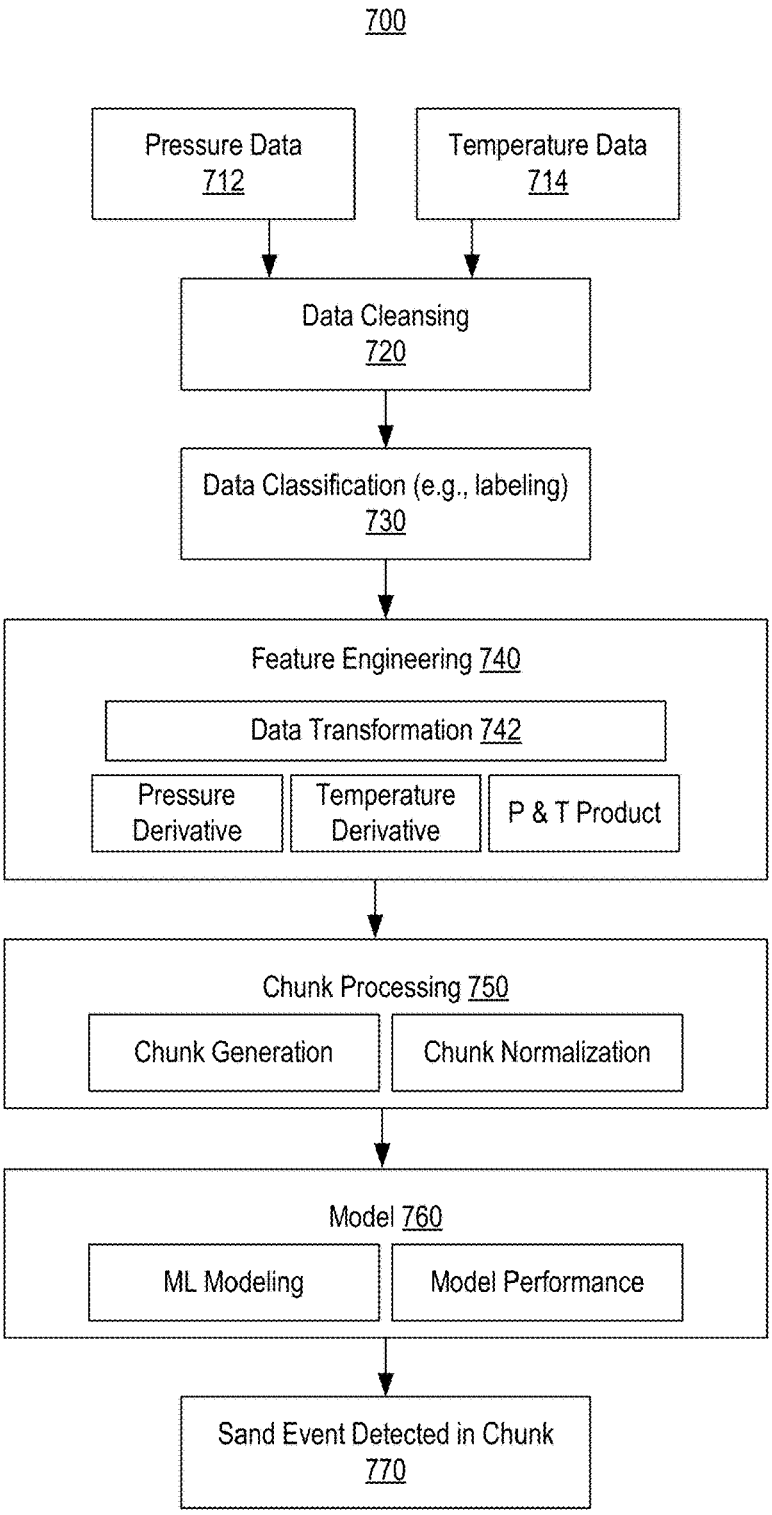
FIG. 7 illustrates an example of a workflow.

FIG. 7 shows an example of a workflow 700 that can be implemented for sand event detection. As shown, the workflow 700 can include a pressure data block 712 and a temperature data block 714 for receiving pressure data and temperature data, respectively. In the example of FIG. 7, a data cleansing block 720 provides for preprocessing of the data, for example, to remove outliers, erroneous data, noise, etc. Once cleansed, clean data can be utilized by a data classification block 730 that can provide for labeling, which may be performed manually, semi-automatically and/or automatically. For example, a human may be present (e.g., a human in the loop (HITL)) that can classify data using wellhead data indicative of one or more sand events. As to an automated approach, consider a matching process that can associate sand events and sensor data, optionally using one or more physics-based models that may utilize one or more types of available data (e.g., flow rate, distances, etc.).

As shown in FIG. 7, once data are classified, a feature engineering block 740 can provide for identifying one or more features that can be utilized in machine learning to build and train one or more ML models. For example, consider a data transformation block 742 that can transform sensor data to become features such as, for example, a pressure derivative feature, a temperature derivative features and a pressure and temperature product feature (e.g., multiplication of a pressure value and a temperature value). Such feature engineering can provide for leveraging trends in pressure data and/or temperature data that occur with respect to time. For example, a derivative is a time derivative that can be a slope with a direction such as an upward slope, a downward slope or a horizontal slope. In various instances, a slope may change with respect to time, for example, moving from upward to downward, from downward to horizontal, etc. As to a product of multiple values, such a feature can act to amplify amplitude when each value is increasing, or decrease amplitude when each value is decreasing. Further, a product approach can act to damp amplitude when one value is going up and another value is going down. Accordingly, a product feature can provide for accentuating certain trends with respect to time.

In the example of FIG. 7, the workflow 700 can include a chunk processing block 750 that can provide for chunk generation and chunk normalization. A chunk can be a segment of data that may be defined with respect to time. For example, consider a chunk of pressure data or a chunk of temperature data as being a portion of time series data. As to chunk determination, which can provide for chunk generation, it can depend on physical phenomena that may be particular to a well, a type of formation, type of equipment utilized, operational conditions, operational goals, etc. As explained with respect to FIG. 6, distances may be factors, which may vary from well to well. Further, conditions in a reservoir may change over time as to sand liberation. For example, when a reservoir exhibits decreased pressure due to production, there may be sand generation due to collapses within the reservoir or there may be less sand entrainment in fluid due to decreased flow. As to the latter, where artificial lift is utilized to increase flow, then sand entrainment may increase compared to where no artificial lift is utilized.

In the example of FIG. 7, the workflow 700 includes a model block 760 that provides for ML modeling and model performance assessment. As an example, a ML model may be selected and built on the basis of features from the feature engineering block 740, on the basis of chunk character from the chunk processing block 750, etc. As shown, output of the model block 760 can be per an output block 770, which may provide for indications of one or more sand events detected in one or more chunks.

The workflow 700 of FIG. 7 may be utilized in one or more modes such as a training mode, a retraining mode, a detection mode, etc. As explained, once a trained ML model is available, it may be implemented for handling field data and predicting sand behavior. For example, the workflow 700 of FIG. 7 may receive field data per the blocks 712 and 714 in real-time during a field operation, cleanse the received data per the block 720, compute features per the block 742 (e.g., transforming clean, received data into features), optionally process the features per the block 750 (e.g., to form feature chunks) and input the features (e.g., features, feature chunks, etc.) to a trained ML model that can detect one or more sand events, which can be output per the output block 770.

As to the workflow 700, consider an example of a well with at least two downhole sensors that measure the temperature and pressure in the well. After performing data transformation, three features can be first derivative of temperature, first derivative of pressure, and a preprocessed product of temperature and pressure. These features can be segmented into feature chunks with a dynamic length window where these feature chunks can be normalized before feeding into a convolution neural network (CNN) model. Where the CNN model is a trained model, it can receive the normalized feature chunks as input and generate output, which may be given in a binary or other manner, optionally along with a probability.

As explained, the workflow 700 can operate in a real-time detection mode. In various trials, the real-time detection mode achieved an F1-score of approximately 98 percent using test data that was separated from a data set that was split into training data and test data. Hence, the test data, as transformed to features and chunked, was able to be processed by a trained ML model to properly detect known sand events (e.g., labeled sand events). Such an approach can be implemented where labels are not available such that the output of the trained ML model includes detected sand events that can be or include future sand events that may appear at surface, depending on whether or not action is taken to mitigate production of sand at a wellhead (e.g., by controlling a pump and/or other equipment).

As an example, time series data may be utilized in a time series ML model and/or time series data may be transformed to an array, which may be more suitable for use with ML models that find use in image analysis tasks. As to time series data from multiple different types of sensors, data may be handled separately by separate models where results can be combined (e.g., merged). For example, consider a recurrent neural network (RNN) or another type of model or models where at least some portions of sensor data may be handled independently.

In various instances, data for training may be augmented, supplemented, etc. For example, consider a simulator that can generate simulated (e.g., synthetic data). As an example, feature engineering may generate one or more additional or alternative features. As an example, where an ESP is involved, one or more features may be ESP specific. For example, consider a motor temperature-based feature (e.g., torque due to presence of sand), an RPM-based feature (RPM due to presence of sand), etc.

As explained, a ML model can be trained using data that can be historical data, for example, from one or more wells where sand events have been identified and/or can be identified for purposes of labeling. In various trials, a data set from three wells along with physical measurements of pressure and temperature were utilized for purposes of training and testing.

As explained, a workflow can include feature engineering to determine features suitable for use in ML modeling. In the example of FIG. 7, pressure and temperature data are mentioned, which can be acquired using downhole sensors. As an example, type of data may be considered a feature such that, for example, pressure data and temperature data are two different features. As indicated in FIG. 7, additional features can include first derivative of pressure and first derivative of temperature, which act to capture changes in time series data. The first derivative corresponds to the gradient in the time series data where, if there is a spike in the series, it refers to a large value (e.g., feature value). As to the product of pressure and temperature, a sand event can be expected to lead to a spike in time series data for pressure and temperature such that this feature can be enabled to highlight the spike.

As explained, aside from type of sensor data, in various trials three examples of features were utilized and incorporated into a modeling phase: (i) the first derivative of temperature, (ii) the first derivative of pressure, and (iii) the product of pressure multiplied by temperature (e.g., a feature P×T). In the trials, the first two features are based on the gradient, which do not necessarily demand bringing time series data to a base of zero (e.g., gradient can be computed regardless of offset). As to the features, a method can include applying a median filter to reduce anomalies where the median filter uses a window of an appropriate length (e.g., consider a window length of approximately 5 minutes). As an example, one or more median filters may be utilized, which may provide for anomaly reduction, which may include anomaly removal, and/or trend reduction, which may include trend removal. As explained, a median filter may be defined with respect to time (e.g., short, medium, long times). In various examples, a short window length may be utilized for anomaly reduction. As an example, as to the third feature, which is the product of temperature and pressure, a longer window may be utilized for tendency reduction (e.g., trend reduction); noting that a longer window median filter may optionally be applied to one or more of the first and second features. As an example, a longer median filter can be applied (e.g., consider 60 minutes) may be applied to one or more features to reduce a trend or trends in the time series data in order to normalize the time series data to a base of zero. As explained, values can be multiplied to generate a product, which can be a combined type feature, for example, of pressure and temperature. As an example, a product may be subjected to one or more filters.

As an example, a three-feature approach can include applying a short median filter to each feature to remove anomalies and can include applying a longer median filter to at least a product of two types of data, where the longer median filter can reduce tendency (e.g., trending); noting that a longer median filter may optionally be applied to one or more other features to reduce tendency (e.g., trending).

As to chunk processing, chunks can be created through a dynamic step sliding window. For example, consider defining a part of a time series containing a sand event as being a "focus zone", in which the sliding window advances more densely (e.g., approximately 3 minutes per step) than in a non-focus zone (e.g., approximately 20 minutes per step). In such an approach, a more balanced chunk data set can be generated. As to "balance", a more balanced data set or more balanced data can be beneficial for training and for actual implementation. As to training, in a trial example, a data set generated through application of a dynamic sliding window had 178 positive label chunks out of 1642 and 1464 negative label chunks out of 1642 (e.g., binary as plus and minus or as 0 and 1, etc.). In this example, the dynamic sliding window increased the positive rate in the data set from 1.93 percent to 10.84 percent.

In an example trial, data were split into a training set and a testing set based on wells. In this trial, a first part of a longer log was utilized for training, and a second part of the longer log was combined with a shorter log for testing. In such an approach, there are no similar chunks used for training in the testing data set, hence, the experience is based on out-of-bag (OOB) data.

As an example, as to chunk normalization, min max normalization can be applied on a chunk level, which will put the time series chunk between 0 and 1, where chunks with a sand event (e.g., a spike in the series) will keep form, while the chunks without a sand event will become a random fold line between 0 and 1.

Figure 8:
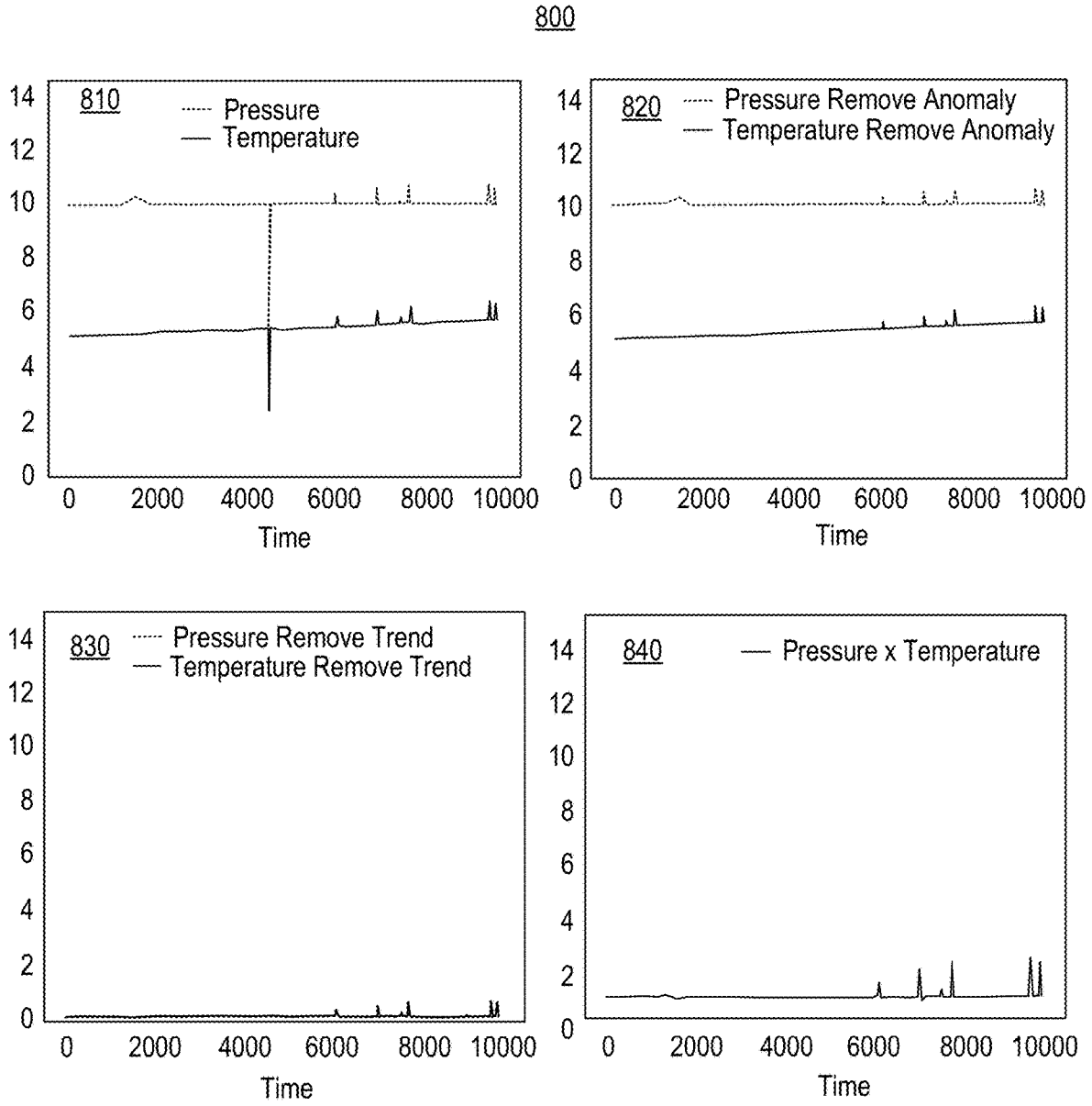
FIG. 8 illustrates examples of plots.

FIG. 8 shows example plots 800 that include a plot of pressure and temperature data versus time 810 (e.g., original data), a plot of processed pressure and temperature data versus time 820 (e.g., after application of a 5 minute median filter), a plot of de-trended pressure and temperature data versus time 830 (e.g., after application of a 60 minute median filter) and a plot of the product of pressure and temperature versus time 840, which is based on the processed and de-trended pressure and temperature data (e.g., product of two transformed features, pressure and temperature). As shown in FIG. 8, the plot 820 can provide for anomaly removal. For example, a spike in the data of the plot 810 is reduced or removed via processing to generate the data in the plot 820.

Figure 9:
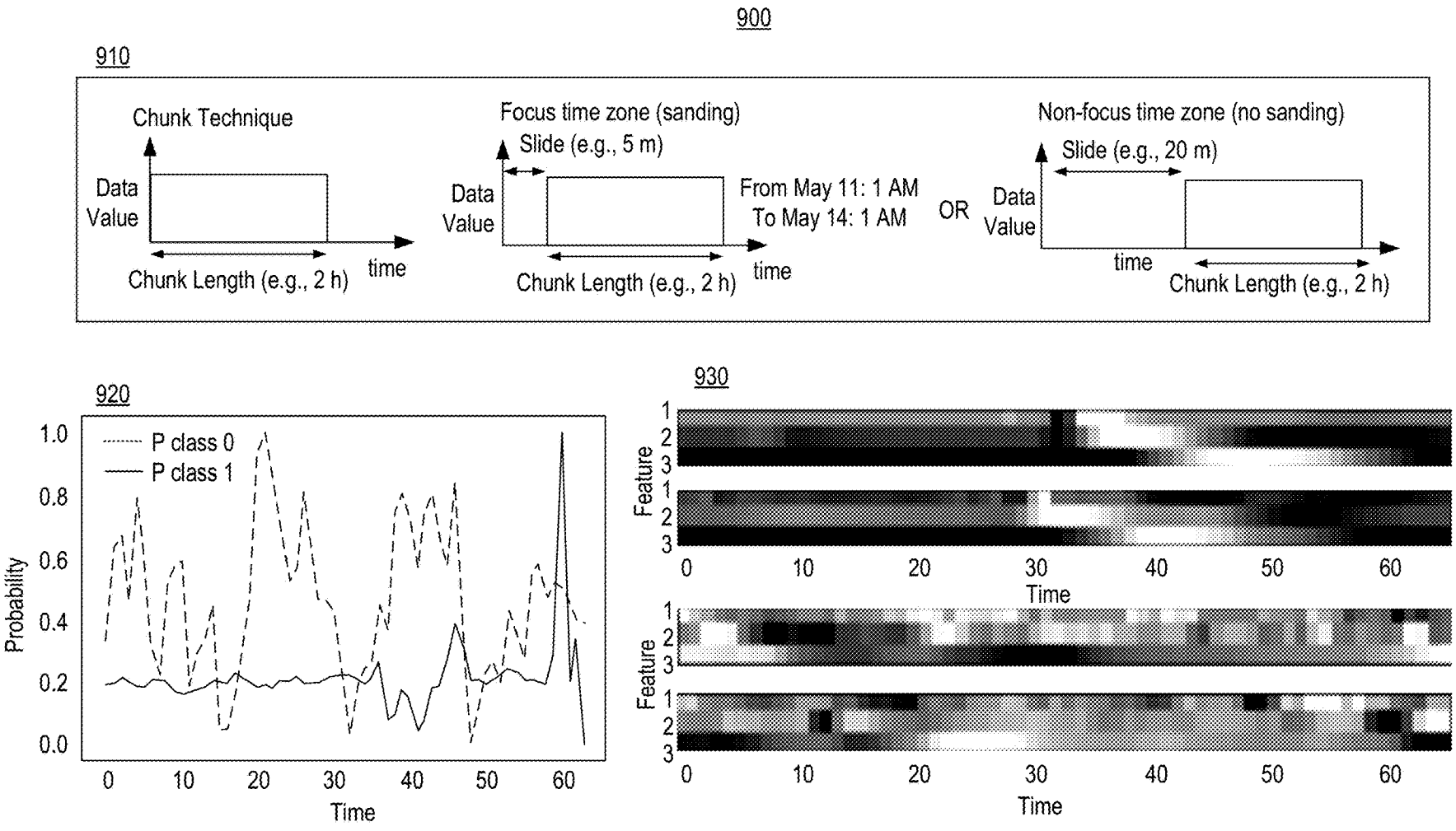
FIG. 9 illustrates examples of plots.

FIG. 9 shows a series of example plots 900, which include a series of chunk plots 910, a chunk normalization plot 920 and time series plots 930. As to the series of chunk plots 910, a first plot shows data value versus time with a chunk length of two hours where a second plot shows how a slide of 5 minutes can be applied to focus the time zone for a sand event and a third plot shows how a slide of 20 minutes can be applied for not focusing where no sand event is present. As to the chunk normalization plot 920, one line represents class 0 (probability (P) class 0 is a no sand event) and another line represents class 1 (probability (P) class 1 is a sand event). As to the class 0 line, it is present as a random folded line; whereas, the class 1 line can demonstrate a clear spike with respect to time that is indicative of a sand event (e.g., as may be occurring at a measured depth of one or more downhole sensors, etc.).

As to the plots 930, these are images (e.g., pixel arrays) formed by concatenating three feature chunks (first derivative pressure, first derivative temperature, and pressure times temperature product). As shown, the plots 930 are each a 3×64 2D image (e.g., 2D image data). As in image data, the value of each pixel can be represented by one or more pixel characteristics such as, for example, one or more of intensity, color, etc. In the example of FIG. 9, a higher value can be a brighter color (e.g., in grayscale, a greater intensity, which may be on a 32, 64, 128, 256, etc., basis). In the instance that there is a sand event in a certain chunk, the color of sand event portion can become brighter than one or more other portions. For example, consider a color scheme for each of the 2D images where a clear yellow color indicates a sand event that stands out from other pixels having a purple color. In such an approach, as the time series chunks become random fold lines, the bright color can be disorderly presented in a 2D image (e.g., brighter color randomly distributed). In such an approach, an individual may visually identify one or more sand event chunks and non-sand event chunks. As an example, a computer vision approach may be implemented, for example, by utilizing one or more types of ML models that are suited to image processing using 2D image data. As explained, a framework such as, for example, the OpenGL framework may be utilized for one or more visualization tasks, image tasks, graphics tasks, etc. For example, various features of a framework may provide for scaling, coloring, highlighting, processing, etc., data and/or other information for one or more purposes (e.g., presentation, analysis, machine learning, etc.).

Figure 10:
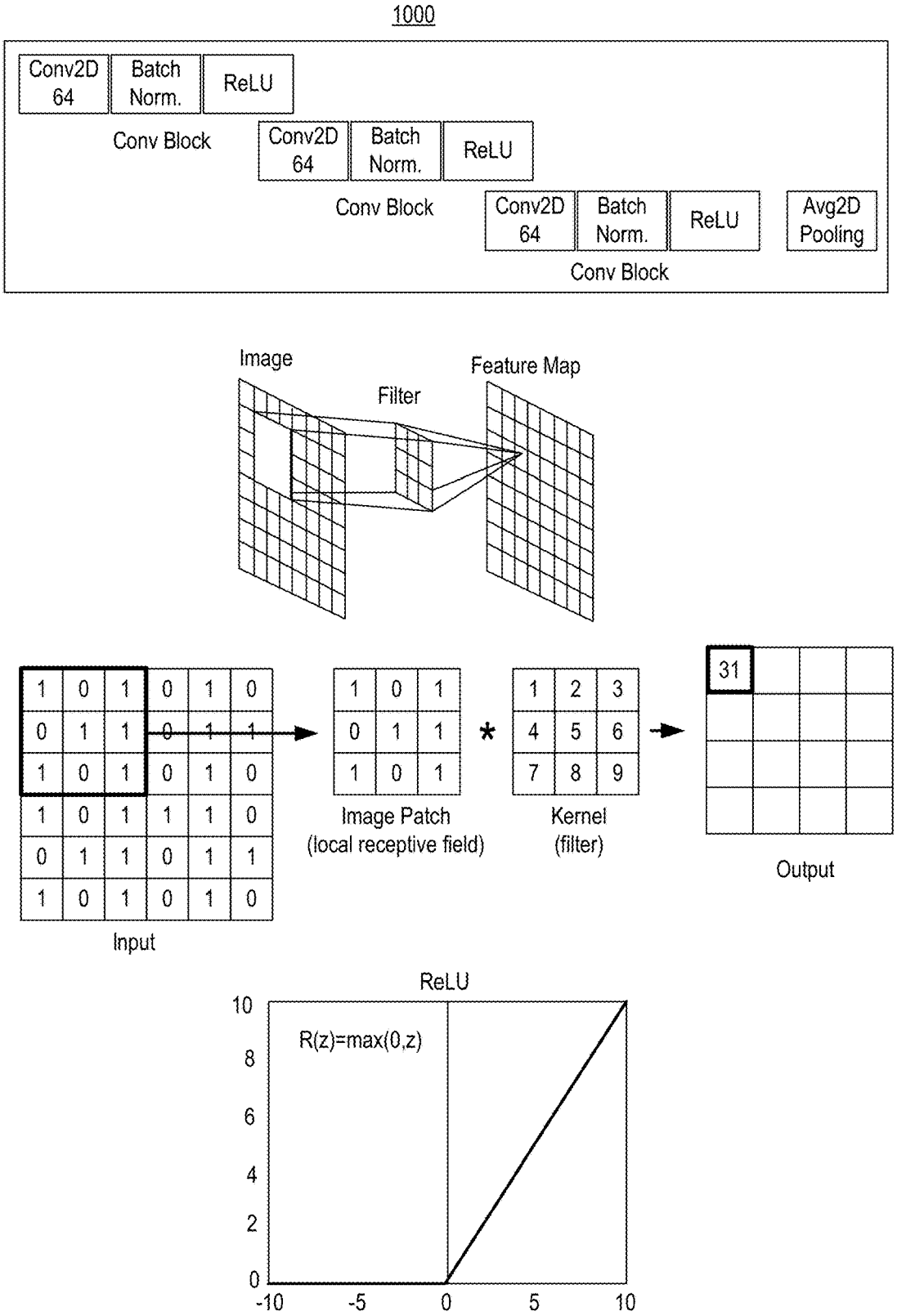
FIG. 10 illustrates an example of a machine learning model architecture.

FIG. 10 shows an example of a CNN-based approach 1000 that can be applied for detecting sand events. In the example of FIG. 10, a CNN architecture is presented that includes three series of blocks with convolution blocks (Conv2D 64), batch normalization blocks and rectified linear unit (ReLU) blocks where these sets of blocks are followed by an average 2D pooling block.

In a CNN, the depth of the network is related to the complexity of the task. As explained with respect to the plots 930 of FIG. 9, input data tends to be relatively small (e.g., three features by chunk increment length such as 3×64 pixels) where the feature to detect is relatively straightforward (e.g., consecutive bright colors). As shown in FIG. 10, three sets of convolutional blocks (Conv2D+Batch Norm.+ ReLU) can be utilized to scan through the image data where output thereof can be processed by an average pooling layer (Avg2D).

As shown in FIG. 10, an image can be processed by a filter to generate a feature map. For example, consider an image as input of pixels with values 0 and 1, where an image patch (e.g., local receptive field) can be filtered using a kernel, which can be a 2D array of values. In the example of FIG. 10, the image patch can be reduced to a single value by application of the kernel, which is presented as a value of 31. In such an approach, the image data can be compressed or transformed to a feature map.

In particular, a convolutional layer provides for a linear operation involving the multiplication of a set of weights with an input image represented by a matrix. The weights set can be referred to as a filter (e.g., consider a 3×3 filter) or kernel, which may be initialized with random values. The input in a convolutional layer is an array with a shape: (number of inputs)×(input height)×(input width)×(input channels). For example, number of inputs can be the number of images to feed to the network by batch; input height can be the number of rows in the image; input width can be the number of columns in the image; and input channels can be colorful images that have three channels and/or gray images that have 1 channel.

Referring to the CNN architecture of FIG. 10, in a first Conv2D layer, there can be 64 hidden units (neurons). Each hidden unit is linked with a local area of the image through the filter. In such an approach, there can be 16 filters in this layer, where each filter generates a channel in the feature map. In such an approach, the generated feature map channels will be concatenated on output. These filters will scan the image from left to right, generate a dot product of image pixel values and filter weight values as output. A dot product is an element-wise multiplication between filter weights and filter sized sample of input data, summed up in a single value.

After passing through a convolutional layer, the image can become transformed to a feature map. Such a feature map can have a shape of (number of inputs)×(feature map height)×(feature map width)×(feature map channels). As to number of inputs, it can be the number of images fed to the network by batch; as to feature map height, it can be the number of rows in feature map; as to feature map width, it can be the number of columns in feature map; and as to feature map channels, it can be the number of filters applied in the convolutional layer.

The output of convolutional layer can be linked with a batch normalization layer (Batch Norm.). A batch normalization normalizes a mini-batch of data across observations for each channel independently. It applies a transformation that maintains the mean output close to 0 and the output standard deviation close to 1.

Thereafter, a rectified linear unit (ReLU) layer can be applied to perform a threshold operation to each element of the input, where a value less than zero is set to zero. In FIG. 10, a plot of a ReLU is shown, which can provide for setting various values to zero.

After the ReLU layer, the first block of the CNN architecture is completed, where the remaining two blocks implement the same features as the first one, however, the number of filters and the number of neurons are different.

At the end, an average pooling layer (Avg2D pooling) can reduce the dimensions of the data by combining the outputs of neuron clusters with an average value at one layer into a single neuron in the next layer. This layer turns the feature map of the last block into an 1D 32 length series. Then, a softmax activation function can be applied to turn the 32-length series to two values, for example, labeled 0 or 1.

The training of a model refers to an update of weights in filters (e.g., which may be initialized with random values). These weights on the filters can be adapted after loss calculation (e.g., misclassifying), for example, according to a gradient descent algorithm. A gradient descent approach can inform the training as to whether there is to be an increase or a decrease in a value of a filter to make the loss smaller. A training approach can take repeated steps in the opposite direction of the gradient where, when the loss becomes stable, the values on the filters become stable as well.

Figure 11:
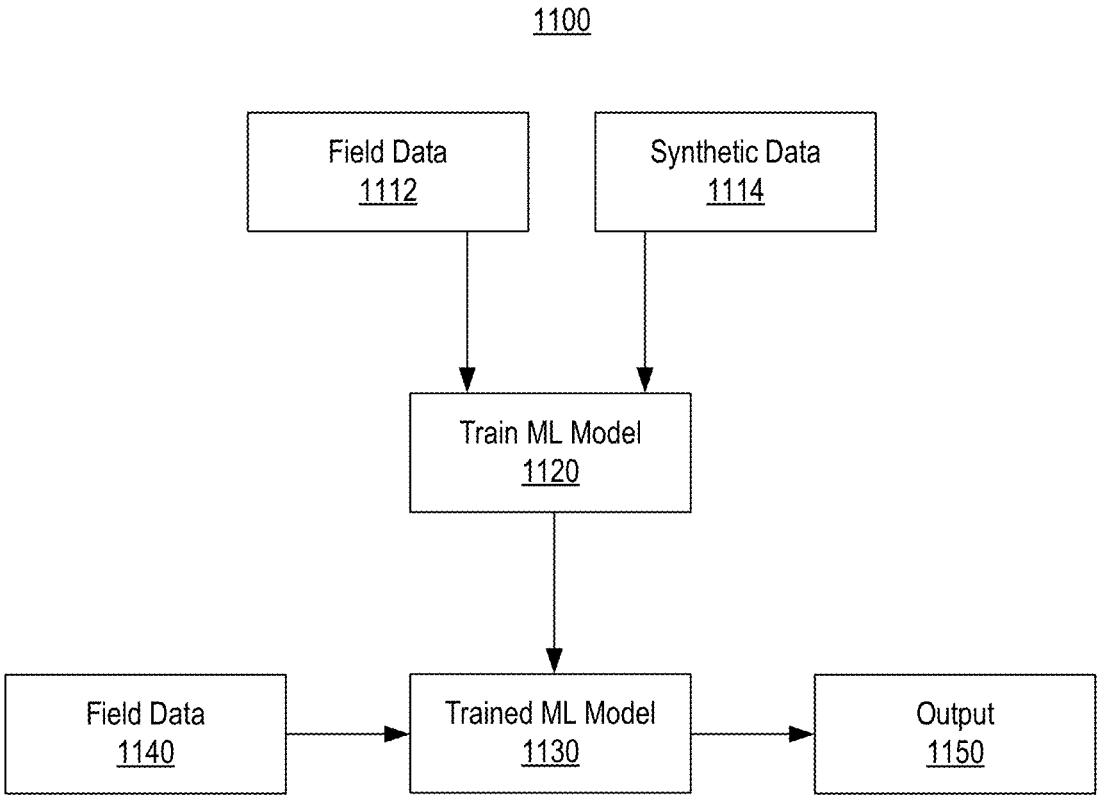
FIG. 11 illustrates an example of a system.

FIG. 11 shows an example of a system 1100 that includes a field data block 1112, a synthetic data block 1114, a training block 1120 for training a ML model, a trained ML model block 1130, another field data block 1140 that can provide field data to the trained ML model of the trained ML model block 1130 to generate output per an output block 1150, which, as explained, can be output indicative of one or more sand behaviors such as, for example, a sand event. In such an example, a trained ML model can be implemented in real-time to process real-time sensor data to detect a possible sand event before sand reaches a wellhead or other portion of a well and/or a surface network. As to the synthetic data block 1114, it may utilize a geomechanics simulator that can generate data as to formation geomechanics that can relate to sand liberation from a formation via one or more mechanisms.

As explained, sanding can result in damage, control issues, NPT, etc. For example, in a gas well, sand may be produced along with fluid which may include water and/or hydrocarbons. Such sand can result in a decision to halt gas production or gas production may itself be substantially halted due to the presence of sand. With a system such as the system 1100 of FIG. 11, a trained ML model can detect a sanding risk prior to sand being produced at surface such that an amount of time exists to take one or more control actions to reduce the risk and/or to maximize gas production.

As explained, a CNN can receive pressure and temperature data (e.g., data derived from one or more pressure sensors, one or more temperature sensors, one or more combined pressure and temperature sensors, etc.) where the CNN can flag a sand event as having occurred downhole over a particular period of time to allow for detection prior to sand being produced at a wellhead. In such an approach, one or more control actions can be taken such that the sand is not produced and/or such that the amount of sand produced is reduced. As to control actions, consider an action that involves control of flow if sanding is detected. For example, by reducing flow, sand, which may have a density heavier than produced fluid, can settle or remain relatively stationary in a wellbore (e.g., a vertical portion, a deviated portion and/or a horizontal portion).

As explained, a sand event can be detected downhole prior to sand being produced at surface. Compared to sanding detectors at surface, a system can allow for earlier detection using downhole data. As explained, a sand detector may be implemented using relatively few sensors (e.g., a pressure sensor, a temperature sensor, a combined pressure and temperature sensor, etc.), which may be deployed as part of a completion string, deployed on a pump string, deployed on a wireline, etc.

As an example, a system for sand detection can provide advance notice as to the potential for sand to be produced at surface such that one or more control actions can be taken (e.g., more time for a controller, an operator, etc., to react to a downhole indication of a sand event).

As an example, a surface unit can provide for issuance of a warning if a downhole sand event is detected. For example, the surface unit can include a display where a graphical user interface can be rendered to provide an indicator that could be used by an operator to stop or otherwise reduce flow as appropriate. As explained, a controller may act responsive to detection of a downhole sand event.

As explained, one or more features of a system may be associated with equipment that can be deployed downhole. For example, the circuitry 460 of FIG. 4 can include one or more features of the edge device 510 of FIG. 5, which can, for example, provide for hosting a detector for sand events. As an example, an ESP may itself be a "smart" ESP that includes one or more executable models (e.g., ML models, etc.) that can provide for detection of a sand event, monitoring and/or control of the ESP. As explained, circuitry may be carried by a gauge that can be mounted to an assembly that includes a pump and a motor where one or more sensors of the gauge can provide inputs to monitoring and/or control circuitry.

As an example, a system, a method, etc., may utilize one or more machine learning (ML) features, which can be implemented using one or more ML models. As to types of ML models, consider one or more of a support vector machine (SVM) model, a k-nearest neighbors (KNN) model, an ensemble classifier model, a neural network (NN) model, etc. As an example, a machine learning model can be a deep learning model (e.g., deep Boltzmann machine, deep belief network, convolutional neural network, stacked auto-encoder, etc.), an ensemble model (e.g., random forest, gradient boosting machine, bootstrapped aggregation, AdaBoost, stacked generalization, gradient boosted regression tree, etc.), a neural network model (e.g., radial basis function network, perceptron, back-propagation, Hopfield network, etc.), a regularization model (e.g., ridge regression, least absolute shrinkage and selection operator, elastic net, least angle regression), a rule system model (e.g., cubist, one rule, zero rule, repeated incremental pruning to produce error reduction), a regression model (e.g., linear regression, ordinary least squares regression, stepwise regression, multivariate adaptive regression splines, locally estimated scatterplot smoothing, logistic regression, etc.), a Bayesian model (e.g., naïve Bayes, average on-dependence estimators, Bayesian belief network, Gaussian naïve Bayes, multinomial naïve Bayes, Bayesian network), a decision tree model (e.g., classification and regression tree, iterative dichotomiser 3, C4.5, C5.0, chi-squared automatic interaction detection, decision stump, conditional decision tree, M5), a dimensionality reduction model (e.g., principal component analysis, partial least squares regression, Sammon mapping, multidimensional scaling, projection pursuit, principal component regression, partial least squares discriminant analysis, mixture discriminant analysis, quadratic discriminant analysis, regularized discriminant analysis, flexible discriminant analysis, linear discriminant analysis, etc.), an instance model (e.g., k-nearest neighbor, learning vector quantization, self-organizing map, locally weighted learning, etc.), a clustering model (e.g., k-means, k-medians, expectation maximization, hierarchical clustering, etc.), etc.

As an example, a machine model may be built using a computational framework with a library, a toolbox, etc., such as, for example, those of the MATLAB framework (MathWorks, Inc., Natick, Massachusetts). The MATLAB framework includes a toolbox that provides supervised and unsupervised machine learning algorithms, including support vector machines (SVMs), boosted and bagged decision trees, k-nearest neighbor (KNN), k-means, k-medoids, hierarchical clustering, Gaussian mixture models, and hidden Markov models. Another MATLAB framework toolbox is the Deep Learning Toolbox (DLT), which provides a framework for designing and implementing deep neural networks with algorithms, pretrained models, and apps. The DLT provides convolutional neural networks (ConvNets, CNNs) and long short-term memory (LSTM) networks to perform classification and regression on image, time-series, and text data. The DLT includes features to build network architectures such as generative adversarial networks (GANs) and Siamese networks using custom training loops, shared weights, and automatic differentiation. The DLT provides for model exchange various other frameworks.

As an example, a system may utilize one or more recurrent neural networks (RNNs). One type of RNN is referred to as long short-term memory (LSTM), which can be a unit or component (e.g., of one or more units) that can be in a layer or layers. A LSTM component can be a type of artificial neural network (ANN) designed to recognize patterns in sequences of data, such as time series data. When provided with time series data, LSTMs take time and sequence into account such that an LSTM can include a temporal dimension. For example, consider utilization of one or more RNNs for processing temporal data from one or more sources, optionally in combination with spatial data. Such an approach may recognize temporal patterns, which may be utilized for making predictions (e.g., as to a pattern or patterns for future times, etc.).

As an example, the TENSORFLOW framework (Google LLC, Mountain View, CA) may be implemented, which is an open source software library for dataflow programming that includes a symbolic math library, which can be implemented for machine learning applications that can include neural networks. As an example, the CAFFE framework may be implemented, which is a DL framework developed by Berkeley AI Research (BAIR) (University of California, Berkeley, California). As another example, consider the SCIKIT platform (e.g., scikit-learn), which utilizes the PYTHON programming language. As an example, a framework such as the APOLLO AI framework may be utilized (APOLLO.AI GmbH, Germany). As an example, a framework such as the PYTORCH framework may be utilized (Facebook AI Research Lab (FAIR), Facebook, Inc., Menlo Park, California).

As an example, a training method can include various actions that can operate on a dataset to train a ML model. As an example, a dataset can be split into training data and test data where test data can provide for evaluation. A method can include cross-validation of parameters and best parameters, which can be provided for model training.

The TENSORFLOW framework can run on multiple CPUs and GPUs (with optional CUDA (NVIDIA Corp., Santa Clara, California) and SYCL (The Khronos Group Inc., Beaverton, Oregon) extensions for general-purpose computing on graphics processing units (GPUs)). TENSORFLOW is available on 64-bit LINUX, MACOS (Apple Inc., Cupertino, California), WINDOWS (Microsoft Corp., Redmond, Washington), and mobile computing platforms including ANDROID (Google LLC, Mountain View, California) and IOS (Apple Inc.) operating system based platforms.

TENSORFLOW computations can be expressed as stateful dataflow graphs; noting that the name TENSORFLOW derives from the operations that such neural networks perform on multidimensional data arrays. Such arrays can be referred to as "tensors".

As an example, a device and/or distributed devices may utilize TENSORFLOW LITE (TFL) or another type of lightweight framework. TFL is a set of tools that enables on-device machine learning where models may run on mobile, embedded, and loT devices. TFL is optimized for on-device machine learning, by addressing latency (no round-trip to a server), privacy (no personal data leaves the device), connectivity (Internet connectivity is demanded), size (reduced model and binary size) and power consumption (e.g., efficient inference and a lack of network connections). TFL offers multiple platform support, covering ANDROID and iOS devices, embedded LINUX, and microcontrollers; diverse language support, which includes JAVA, SWIFT, Objective-C, C++, and PYTHON; and high performance, with hardware acceleration and model optimization. Machine learning tasks may include, for example, data processing, image classification, object detection, pose estimation, question answering, text classification, etc., on multiple platforms. As an example, the system 500 of FIG. 5 may utilize one or more features of the TFL framework.

Figure 12:
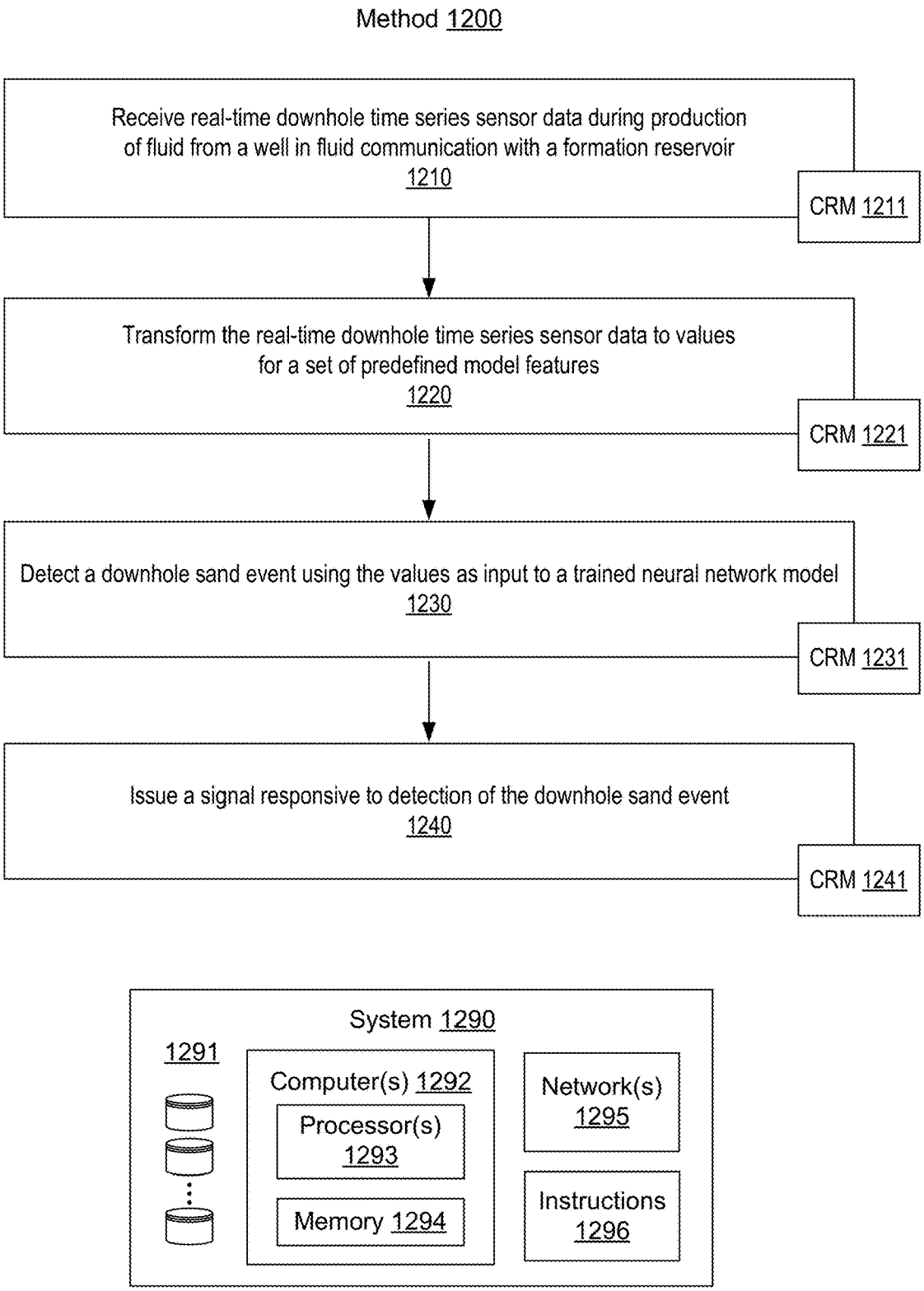
FIG. 12 illustrates an example of a method and an example of a system.

FIG. 12 shows an example of a method 1200 and an example of a system 1290. As shown, the method 1200 can include a reception block 1210 for receiving real-time downhole time series sensor data during production of fluid from a well in fluid communication with a formation reservoir; a transformation block 1220 for transforming the real-time downhole time series sensor data to values for a set of predefined model features; a detection block 1230 for detecting a downhole sand event using the values as input to a trained neural network model; and an issuance block 1240 for issuing a signal responsive to detection of the downhole sand event.

The method 1200 is shown in FIG. 12 in association with various computer-readable media (CRM) blocks 1211, 1221, 1231 and 1241. Such blocks generally include instructions suitable for execution by one or more processors (or processor cores) to instruct a computing device or system to perform one or more actions. While various blocks are shown, a single medium may be configured with instructions to allow for, at least in part, performance of various actions of the method 1200. As an example, a computer-readable medium (CRM) may be a computer-readable storage medium that is non-transitory and that is not a carrier wave. As an example, one or more of the blocks 1211, 1221, 1231 and 1241 may be in the form processor-executable instructions.

In the example of FIG. 12, the system 1290, which may be a wellsite system, can include one or more information storage devices 1291, one or more computers 1292, one or more networks 1295 and instructions 1296. As to the one or more computers 1292, each computer may include one or more processors (e.g., or processing cores) 1293 and memory 1294 for storing the instructions 1296, for example, executable by at least one of the one or more processors 1293 (see, e.g., the blocks 1211, 1221, 1231 and 1241). As an example, a computer may include one or more network interfaces (e.g., wired or wireless), one or more graphics cards, a display interface (e.g., wired or wireless), etc.

As an example, the system 250, the system 400, the system 500, the system 600, the system 1100, etc., may include memory that can store instructions such as instructions of one or more of the CRM blocks 1211, 1221, 1231 and 1241. As explained, a system can be operatively coupled to equipment in the field where, for example, the system can receive data from the equipment (e.g., directly and/or indirectly) and, as appropriate, issue one or more commands (e.g., control signals, etc.) to the equipment to cause the equipment to take one or more actions. As explained, an action may aim to avert sand production at surface, diminish wear to equipment, etc. In the realm of ESPs, as explained, an action or actions can address equipment and/or environment (e.g., consider sanding, flow, pressure, temperature, etc.).

As an example, a method can include receiving real-time downhole time series sensor data during production of fluid from a well in fluid communication with a formation reservoir; transforming the real-time downhole time series sensor data to values for a set of predefined model features; detecting a downhole sand event using the values as input to a trained neural network model; and issuing a signal responsive to detection of the downhole sand event. In such an example, the real-time downhole time series sensor data can include one or more of pressure data and temperature data. As an example, pressure and temperature data may be acquired using one or more sensors, which may be positioned a distance or distances from a wellhead of a well, for example, consider one or more sensors positioned downhole in a well and upstream from the wellhead.

As an example, a method can utilize predefined model features where at least one of the predefined model features does not depend on an amplitude offset of real-time downhole time series sensor data. As an example, at least one of a number of predefined model features can be a derivative with respect to time. For example, two predefined model features can be derivatives with respect to time. As an example, predefined model features can include derivatives with respect to time such as, for example, a first derivative of pressure data with respect to time and a first derivative of temperature data with respect to time.

As an example, a method can utilize predefined model features where at least one of the predefined model features can be a product of at least two different types of sensor data. For example, consider the at least two different types of sensor data as being pressure sensor data and temperature sensor data, which may be acquired by one or more sensors.

As an example, real-time downhole time series sensor data can be acquired using at least one sensor of pump equipment disposed in a well. For example, consider the pump equipment as including or being an electric submersible pump (ESP). In such an example, the ESP may include a gauge that includes multiple sensors that can acquire sensor data where circuitry of the gauge can transmit the sensor data (e.g., raw, compressed, processed, etc.) to uphole equipment, which may be or include surface equipment (e.g., a surface unit). In such an example, the uphole equipment may include one or more computational framework components for using the sensor data for detection of one or more sand events (e.g., downhole events). In response, the surface equipment may issue one or more control instructions (e.g., commands, etc.) to adjust one or more pieces of equipment to reduce the risk or the amount of sand produced at surface due to one or more of the one or more detected sand events. In such an example, a surface controller of the ESP may adjust one or more control parameters of the ESP as a response (e.g., consider a frequency parameter that controls motor speed of the ESP and hence flow rate, etc.). As an example, a lower flow rate may cause sand to move less rapidly toward a wellhead and may, for example, cause at least some amount of sand to settle.

As an example, a method can include issuing that issues a signal to a controller responsive to detection of a sand event. As an example, issuing can issue a signal as a control signal that controls at least one field component. For example, consider the at least one field component to be or include one or more of an adjustable choke, an electric submersible pump, and a gas lift component.

As an example, a trained neural network model can be or include a convolution neural network (CNN) model. In such an example, a method can include transforming that transforms real-time downhole time series sensor data to a multidimensional array. For example, consider a multidimensional array that can be a pixel array. As an example, a multidimensional array can include a feature dimension that has indices that correspond to individual predefined model features and another dimension that corresponds to time.

As an example, a system can include a processor; memory accessible to the processor; and processor-executable instructions stored in the memory to instruct the system to: receive real-time downhole time series sensor data during production of fluid from a well in fluid communication with a formation reservoir; transform the real-time downhole time series sensor data to values for a set of predefined model features; detect a downhole sand event using the values as input to a trained neural network model; and issue a signal responsive to detection of the downhole sand event.

As an example, one or more computer-readable storage media can include processor-executable instructions to instruct a computing system to: receive real-time downhole time series sensor data during production of fluid from a well in fluid communication with a formation reservoir; transform the real-time downhole time series sensor data to values for a set of predefined model features; detect a downhole sand event using the values as input to a trained neural network model; and issue a signal responsive to detection of the downhole sand event.

As an example, a computer program product can include one or more computer-readable storage media that can include processor-executable instructions to instruct a computing system to perform one or more methods and/or one or more portions of a method. Various example methods may be performed in various combinations.

Figure 13:
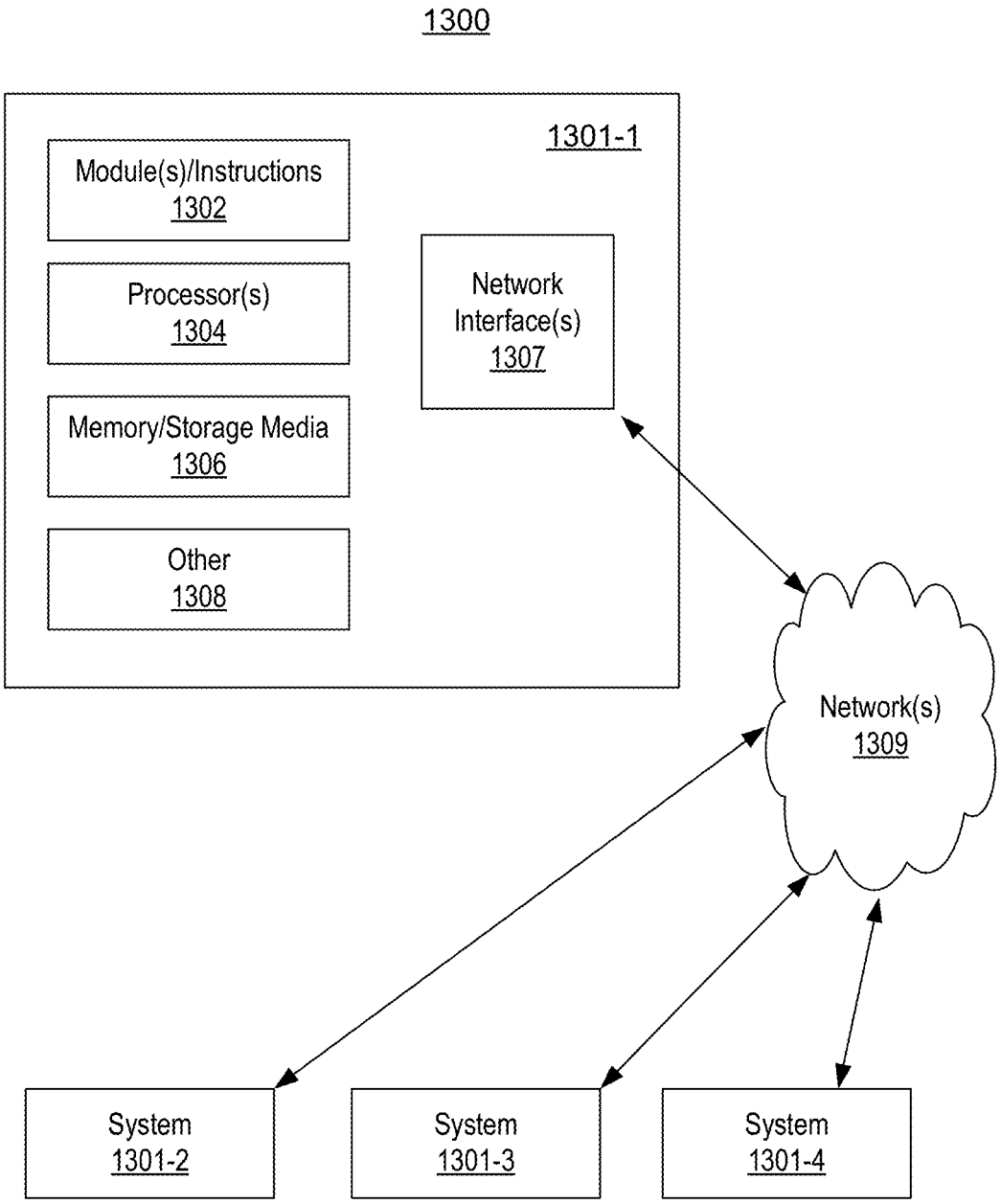
FIG. 13 illustrates examples of computer and network equipment.

In some embodiments, a method or methods may be executed by a computing system. FIG. 13 shows an example of a system 1300 that can include one or more computing systems 1301-1, 1301-2, 1301-3 and 1301-4, which may be operatively coupled via one or more networks 1309, which may include wired and/or wireless networks; noting that one or more other features 1308 can be included in the system 1300.

As an example, a system can include an individual computer system or an arrangement of distributed computer systems. In the example of FIG. 13, the computer system 1301-1 can include one or more modules 1302, which may be or include processor-executable instructions, for example, executable to perform various tasks (e.g., receiving information, requesting information, processing information, simulation, outputting information, etc.).

As an example, a module may be executed independently, or in coordination with, one or more processors 1304, which is (or are) operatively coupled to one or more storage media 1306 (e.g., via wire, wirelessly, etc.). As an example, one or more of the one or more processors 1304 can be operatively coupled to at least one of one or more network interface 1307. In such an example, the computer system 1301-1 can transmit and/or receive information, for example, via the one or more networks 1309 (e.g., consider one or more of the Internet, a private network, a cellular network, a satellite network, etc.).

As an example, the computer system 1301-1 may receive from and/or transmit information to one or more other devices, which may be or include, for example, one or more of the computer systems 1301-2, etc. A device may be located in a physical location that differs from that of the computer system 1301-1. As an example, a location may be, for example, a processing facility location, a data center location (e.g., server farm, etc.), a rig location, a wellsite location, a downhole location, etc.

As an example, a processor may be or include a microprocessor, microcontroller, processor module or subsystem, programmable integrated circuit, programmable gate array, or another control or computing device.

As an example, the storage media 1306 may be implemented as one or more computer-readable or machine-readable storage media. As an example, storage may be distributed within and/or across multiple internal and/or external enclosures of a computing system and/or additional computing systems.

As an example, a storage medium or storage media may include one or more different forms of memory including semiconductor memory devices such as dynamic or static random access memories (DRAMs or SRAMs), erasable and programmable read-only memories (EPROMs), electrically erasable and programmable read-only memories (EEPROMs) and flash memories, magnetic disks such as fixed, floppy and removable disks, other magnetic media including tape, optical media such as compact disks (CDs) or digital video disks (DVDs), BLUERAY disks, or other types of optical storage, or other types of storage devices.

As an example, a storage medium or media may be located in a machine running machine-readable instructions, or located at a remote site from which machine-readable instructions may be downloaded over a network for execution.

As an example, various components of a system such as, for example, a computer system, may be implemented in hardware, software, or a combination of both hardware and software (e.g., including firmware), including one or more signal processing and/or application specific integrated circuits.

As an example, a system may include a processing apparatus that may be or include a general-purpose processors or application specific chips (e.g., or chipsets), such as ASICs, FPGAs, PLDs, or other appropriate devices.

As an example, a device may be a mobile device that includes one or more network interfaces for communication of information. For example, a mobile device may include a wireless network interface (e.g., operable via IEEE 802.11, ETSI GSM, BLUETOOTH, satellite, etc.). As an example, a mobile device may include components such as a main processor, memory, a display, display graphics circuitry (e.g., optionally including touch and gesture circuitry), a SIM slot, audio/video circuitry, motion processing circuitry (e.g., accelerometer, gyroscope), wireless LAN circuitry, smart card circuitry, transmitter circuitry, GPS circuitry, and a battery. As an example, a mobile device may be configured as a cell phone, a tablet, etc. As an example, a method may be implemented (e.g., wholly or in part) using a mobile device. As an example, a system may include one or more mobile devices.

As an example, a system may be a distributed environment, for example, a so-called "cloud" environment where various devices, components, etc. interact for purposes of data storage, communications, computing, etc. As an example, a device or a system may include one or more components for communication of information via one or more of the Internet (e.g., where communication occurs via one or more Internet protocols), a cellular network, a satellite network, etc. As an example, a method may be implemented in a distributed environment (e.g., wholly or in part as a cloud-based service).

Although only a few example embodiments have been described in detail above, those skilled in the art will readily appreciate that many modifications are possible in the example embodiments. Accordingly, all such modifications are intended to be included within the scope of this disclosure as defined in the following claims. In the claims, means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures.

What is claimed is:

1. A method comprising:

receiving real-time downhole time series sensor data during production of fluid from a well in fluid communication with a formation reservoir;

transforming the real-time downhole time series sensor data to values for a set of predefined model features, wherein at least one of the predefined model features is a product of at least two different types of sensor data including pressure sensor data and temperature sensor data;

detecting a downhole sand event using the values as input to a trained neural network model; and responsive to detecting the downhole sand event, adjusting operation of pump equipment disposed in the well.

2. The method of claim 1, wherein the real-time downhole time series sensor data comprise one or more of pressure data and temperature data.

3. The method of claim 1, wherein at least one of the predefined model features does not depend on an amplitude offset of the real-time downhole time series sensor data.

4. The method of claim 1, wherein at least one of the predefined model features is a derivative with respect to time.

5. The method of claim 1, wherein two of the predefined model features are derivatives with respect to time.

6. The method of claim 5, wherein the derivatives with respect to time comprise a first derivative of pressure data with respect to time and a first derivative of temperature data with respect to time.

7. The method of claim 1, wherein the real-time downhole time series sensor data are acquired using at least one sensor of pump equipment disposed in the well.

8. The method of claim 7, wherein the pump equipment comprises an electric submersible pump.

9. The method of claim 1, wherein receiving the real-time downhole time series sensor data includes:

receiving, during production of fluid, first real-time downhole time series sensor data from a pressure sensor positioned in a well, the pressure sensor associated with the pump equipment disposed in the well; and receiving, during the production of fluid, second real-time downhole time series sensor data from a temperature sensor positioned in the well, the temperature sensor associated with the pump equipment disposed in the well.

10. The method of claim 1, wherein adjusting operation of the pump equipment includes controlling operation of at least one field component.

11. The method of claim 10, wherein the at least one field component comprises an adjustable choke.

12. The method of claim 10, wherein the at least one field component comprises an electric submersible pump.

13. The method of claim 10, wherein the at least one field component comprises a gas lift component.

14. The method of claim 1, wherein the trained neural network model comprises a convolution neural network model.

15. The method of claim 14, wherein the transforming comprises transforming the real-time downhole time series sensor data to a multidimensional array.

16. The method of claim 15, wherein the multidimensional array comprises a pixel array.

17. A system comprising:

a processor;

memory accessible to the processor; and processor-executable instructions stored in the memory to instruct the system to:

receive real-time downhole time series sensor data during production of fluid from a well in fluid communication with a formation reservoir;

transform the real-time downhole time series sensor data to values for a set of predefined model features, wherein at least one of the predefined model features is a product of at least two different types of sensor data including pressure sensor data and temperature sensor data;

detect a downhole sand event using the values as input to a trained neural network model; and responsive to detecting the downhole sand event, adjust operation of pump equipment disposed in the well.

18. One or more computer-readable storage media comprising processor-executable instructions to instruct a computing system to:

receive real-time downhole time series sensor data during production of fluid from a well in fluid communication with a formation reservoir;

transform the real-time downhole time series sensor data to values for a set of predefined model features, wherein at least one of the predefined model features is a product of at least two different types of sensor data including pressure sensor data and temperature sensor data;

detect a downhole sand event using the values as input to a trained neural network model; and responsive to detecting the downhole sand event, adjust operation of pump equipment disposed in the well.

* * * * *